US007404697B2

(12) United States Patent
Thompson

(10) Patent No.: US 7,404,697 B2
(45) Date of Patent: Jul. 29, 2008

(54) HEIGHT-ADJUSTABLE PIPE PICK-UP AND LAYDOWN MACHINE

(75) Inventor: Carroll R. Thompson, The Woodlands, TX (US)

(73) Assignee: Technologies Alliance, Inc., Houston, TX (US)

( * ) Notice: Subject to any disclaimer, the term of this patent is extended or adjusted under 35 U.S.C. 154(b) by 110 days.

(21) Appl. No.: 10/513,543

(22) PCT Filed: May 2, 2003

(86) PCT No.: PCT/US03/13767

§ 371 (c)(1),
(2), (4) Date: Aug. 25, 2005

(87) PCT Pub. No.: WO03/093629

PCT Pub. Date: Nov. 13, 2003

(65) Prior Publication Data

US 2006/0104746 A1 May 18, 2006

Related U.S. Application Data

(60) Provisional application No. 60/377,431, filed on May 3, 2002.

(51) Int. Cl.
*E21B 19/00* (2006.01)

(52) U.S. Cl. ..... 414/22.58

(58) Field of Classification Search ..... 414/22.52, 414/22.54, 22.55, 22.57, 22.58, 22.61, 22.62, 414/22.65, 22.68, 22.69, 22.71, 232, 745.9, 414/746.1, 746.2, 746.4, 746.8, 339, 349, 414/742, 743; 175/52, 85; 52/116; 89/1.8, 89/1.801; 14/71.7, 71.1, 71.5, 72.5, 69.5
See application file for complete search history.

(56) References Cited

U.S. PATENT DOCUMENTS 4,067,453 A * 1/1978 Moller ..... 414/22.61
4,235,566 A 11/1980 Beeman et al.

(Continued)

OTHER PUBLICATIONS

PCT International Search Report dated Oct. 6, 2003 based on PCT/US03/13767.

*Primary Examiner*—Saul J. Rodriguez
*Assistant Examiner*—Gregory W Adams
(74) *Attorney, Agent, or Firm*—Patterson & Sheridan, L.L.P.

(57) ABSTRACT

The present invention provides a pipe-handling machine (100) for picking up and laying down pipe, such as at a rig site. The machine first comprises three elongated and nested truss members. First, a trestle (200) is provided; second, a trough carrier (300) is received within the trestle; and third, a trough (400) is slidably received within the trough carrier. The machine next comprises an inclined ramp (500). A lower end of the ramp is pivotally connected to the trestle, while an upper end of the ramp extends upward to the rig floor. The length of the ramp is adjustable to accommodate rig floors of varying heights. A trestle transport mechanism (550) selectively moves a front end of the trestle upwards along the ramp, thereby delivering a joint of pipe to the rig floor. The trough may optionally be moved along the trough carrier and out over the rig floor to aid in delivery. Features (310) may optionally be incorporated to reduce the angle of approach of the joint of pipe relative to the rig floor after the trestle transport mechanism is actuated.

44 Claims, 31 Drawing Sheets

U.S. PATENT DOCUMENTS 4,386,883 A * 6/1983 Hogan et al. ..... 414/22.61
4,403,898 A * 9/1983 Thompson ..... 414/22.58
4,684,314 A * 8/1987 Luth ..... 414/746.1
5,137,114 A * 8/1992 Yde et al. ..... 182/49
5,511,267 A * 4/1996 Alexander ..... 14/71.7
6,079,925 A * 6/2000 Morgan et al. ..... 414/22.57

* cited by examiner

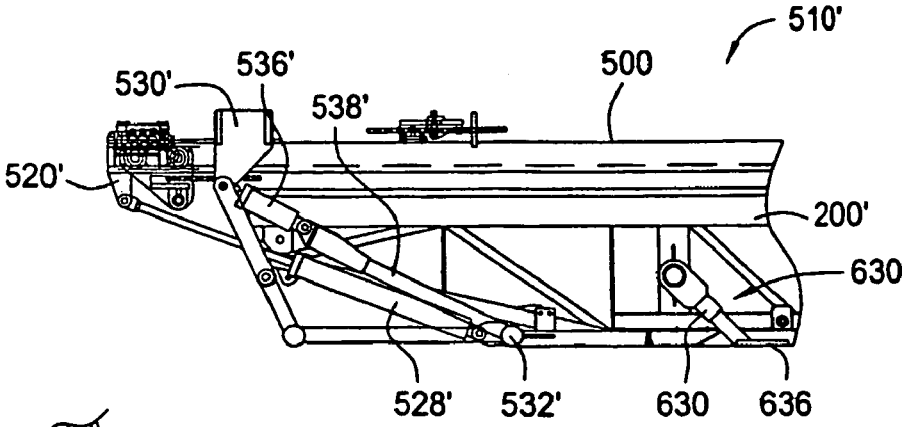
FIG. 4C ( 1 )
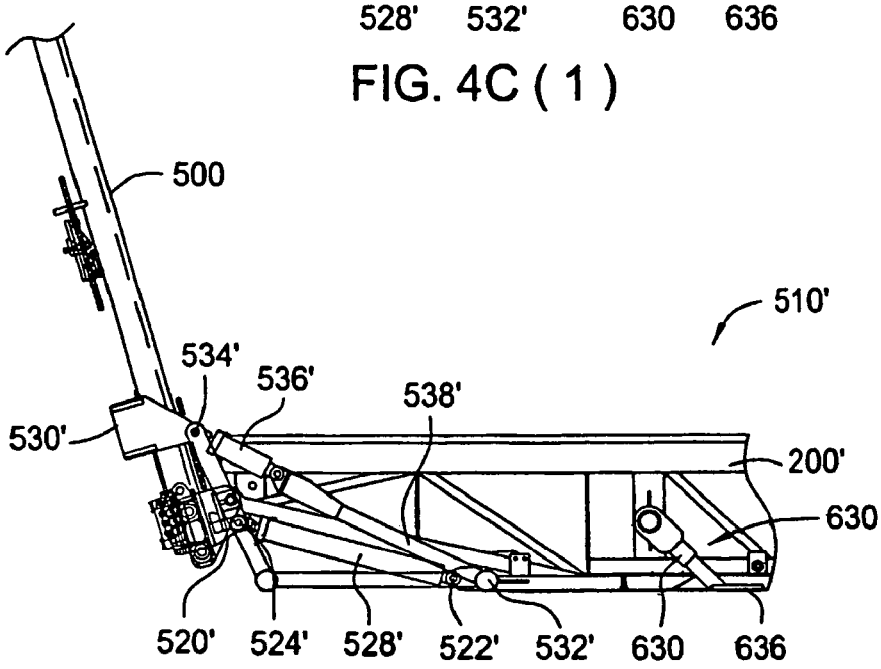
FIG. 4C ( 2 )
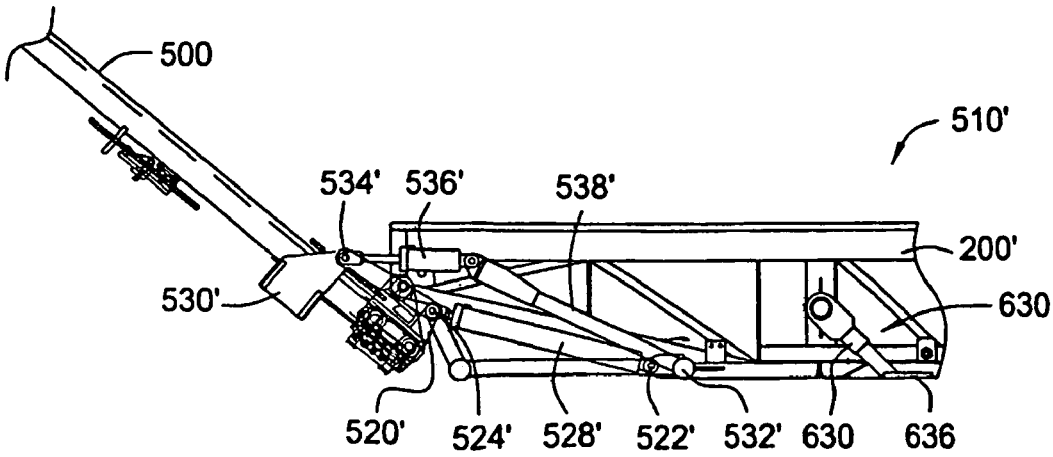
FIG. 4C ( 3 )

HEIGHT-ADJUSTABLE PIPE PICK-UP AND LAYDOWN MACHINE

CROSS-REFERENCE TO RELATED APPLICATIONS

This new application for letters patent claims priority from an earlier-filed United States provisional patent application entitled "Height Adjustable Pipe Pick-Up and Laydown Machine." That application was filed on May 3, 2002 and was assigned Application No. 60/377,431. The provisional application is incorporated herein by reference.

BACKGROUND OF THE INVENTION

1. Field of the Invention

The present invention relates to pipe handling systems for handling a tubular pipe. More particularly, the present invention relates to pipe pick-up and lay-down systems for use in drilling operations.

2. Background of the Related Art

In the drilling of oil and gas wells, it is known to employ various types of tubular pipe. Such pipes include drill pipe, drill collars, production tubing, well casing, and riser pipe. Such pipe is delivered to the drilling rig, and laid in individual joints horizontally upon a pipe rack. In the case of land wells, the pipe is typically delivered by a flat-bed truck. For offshore drilling, the pipe is delivered by barge or on a large floating vessel.

In order to use the pipe on the drilling rig, it is necessary to transport the pipe from the pipe rack to the rig floor. However, picking up and laying down drill pipe, casing and other tubular goods presents certain hazards to personnel on the rig floor. In addition, the manual handling of pipe, even with the assistance of wirelines, creates a risk that the pipe threads may be damaged. These concerns are magnified by the ever-increasing height of rig floors necessitated by the drilling of deeper wells.

Various patents have issued which provide pipe pick-up and laydown systems. These systems typically involve the use of wirelines or cables to transport pipe from a pipe rack or truck bed to the rig floor. Such patents include:

U.S. Pat. No. 4,491,450 issued to George on Jan. 1, 1985;

U.S. Pat. No. 4,054,310 issued to Crocker on Oct. 18, 1977;

U.S. Pat. No. 4,099,630 issued to Beck on Jul. 11, 1978; and

U.S. Pat. No. 4,082,193 issued to Teague on Apr. 4, 1978.

These patents disclose systems that, while commonly used, require manual manipulation of pipes.

Other patents have attempted to reduce the involvement of rig hands in the handling of pipe by providing a trough for lifting pipe from the pipe rack to the rig floor. Such patents include:

U.S. Pat. No. 4,235,566 issued to Beaman, et al. on Nov. 25, 1980;

U.S. Pat. No. 4,054,310 issued to Thompson on Sep. 13, 1983; and

U.S. Pat. No. 4,552,498 issued to Dysarz on Nov. 12, 1985.

However, these systems are not readily adaptable to rigs of varying heights. In this respect, higher rig floors create steeper angles of approach from the catwalk or pipe handling area to the rig floor. If the angle of approach is too steep, the upper end of the joint of pipe will be too high above the rig floor for a worker standing on the floor to safely reach. Therefore, means are required to raise the rear end of the pipe to lower the angle of approach for the upper end of the pipe with respect to the elevated rig floor. It is thus desirable to be able to lift the pipe from the rear portion so as to reduce the angle at which the pipe is fed onto the rig floor.

U.S. Pat. No. 4,486,137 issued to Buckner on Dec. 4, 1984 provides a machine that lifts a pipe trough from the rear; however, a cable is apparently still required for lifting the front end of the trough to the rig floor.

Therefore, it is desirable to provide a pipe pick-up and laydown system that includes a V-Door ramp of adjustable height so as to adapt the pick-up and laydown system to rigs of various heights. Still further, it is desirable to provide a pick-up and laydown system that has improved mobility for quickly delivering the system to the wellsites. Further still, a need exists for a system that enables pipe to be picked up from a pipe rack, placed in a trough, and the trough and pipe moved to a position on the drilling rig floor without the need for a cable or wireline attachment to the pipe.

There is yet a further need for such a system that delivers pipe over the rig floor a greater distance than known systems. In this regard, it is desirable to deliver pipe as close as possible to the wellbore being formed. In this manner, the rear end of the delivered pipe does not swing as much when the pipe is lifted from the pickup and laydown system.

In addition, there is a need for a pipe-handling machine that can be operated solely through hydraulic power. There is further a need for a pipe manipulation system having a greater capability for adjusting the angle at which pipe is presented to the rig floor. Finally, a need exists for a pipe pick-up and laydown system that is essentially remotely operable.

SUMMARY OF THE INVENTION

The present invention provides a novel pipe pick-up and laydown machine. In one arrangement, the machine is remotely operable, and requires minimal manual manipulation of pipe joints by the rig hands. In addition, the machine can be adjusted to accommodate rigs of different floor heights.

The pipe pick-up and laydown machine constitutes a pipe-handling machine for handling pipe at a drilling rig. More specifically, the pipe-handling machine is able to receive a joint of pipe from a pipe rack at ground level, and deliver it to the rig floor for vertical stacking and use in drilling or work-over operations. Reciprocally, the pipe-handling machine is able to receive pipe from the rig floor, and return it back to ground level where it can be expelled onto an adjacent pipe rack.

The pipe-handling machine generally comprises three separate frames, and a ramp. The frames are carried upward towards a rig floor together along the connected ramp. The three frames and the ramp may be positioned on the catwalk of a drilling rig adjacent the pipe rack. In one aspect, the ramp may be folded over the three nested frames for ease of transport. Upon delivery to the rig site, the ramp is unfolded and elevated so that it leans against the rig. Preferably, the ramp is then supported by the V-Door ramp.

After the ramp is unfolded into a position leaning against the rig, a pipe is received into the pipe-handling machine. More specifically, the pipe is received onto the three frames. Each of the three frames defines an elongated frame structure having a concave upper surface. The first frame is a trestle; the second frame is a trough carrier; and the third frame is a trough for receiving pipe. The three frames are nested, meaning that the trough is received within the trough carrier, while the trough carrier is received within the trestle. To accomplish this nesting arrangement, the upper surface of the trestle is configured to receive the trough carrier, while the upper concave surface of the trough carrier is configured to receive the trough. Finally, the upper surface of the trough is configured to receive a joint of pipe.

A front end of the trestle is pivotally connected to the ramp. As the front end of the trestle is pulled upwards towards the rig floor, the trough carrier and the trough are carried with it. The back end of the trough is pulled along the catwalk as the front end moves forward and upward. In one aspect, the back end of the trestle rides within a base frame that provides lateral support. In one aspect, the rear portion of the trestle defines an articulating leg that may be folded over, thereby reducing the overall length of the trestle during transport. This, in turn, allows the machine to be transported on land via flatbed truck without a DOT permit.

The articulating leg first moves forward within the base frame as the front end of the trestle is elevated along the inclined ramp. The articulating leg engages a stop member in the base frame, causing the rear portion of the trestle to pivot and to be raised off the ground. This serves to reduce the angle of approach for tubulars as they are delivered to the rig floor. The operation is reversed when laying down pipe.

As noted, the trestle receives the trough carrier. In one embodiment, the trough carrier is connected to the trestle by a trough carrier transport mechanism. In one aspect, the trough carrier transport mechanism defines a hydraulic cylinder connected at the rear of the trough carrier, and having an extendable, telescoping arm. Depending upon the configuration of the transport mechanism, the trough carrier may be moved longitudinally along the trestle, may be lifted upward relative to the trestle, or both. The trough carrier transport mechanism is actuated once the front end of the trestle has been raised to the rig floor.

The trough carrier, in turn, receives an elongated trough. The trough has a concave upper surface for receiving pipe from the adjoining pipe rack. In this manner, the trough serves as a cradle for pipe during a pick-up or laydown operation. The trough is slidably mounted within the trough carrier by a trough transport mechanism. The trough transport mechanism, in one arrangement, comprises a hydraulically actuated arm for telescopically extending the trough out of the forward end of the trestle and towards the drilling rig. The trough transport mechanism is actuated once the forward end of the trough has reached the rig floor.

Returning to the ramp, the ramp has a frame structure, and an extendable arm that travels upward within the frame. Preferably, extension is accomplished by a hydraulic arm having telescoping sections. The inclined ramp may be assembled in modules, allowing additional sections to be incorporated for higher rig floor heights. In one arrangement, modules permit the ramp to be dimensioned between 16 and 35 feet in total length.

A carriage is provided on the inclined ramp. The carriage rides along a channel provided in the frame. At the same time, the carriage is pivotally connected to the trestle. Thus, a lifting of the carriage along the channel carries the front end of the trough to the rig floor. In one aspect, the carriage is lifted via chains that are pulled over a sheave at the distal end of the hydraulic arm within the ramp. The result is that for each foot the hydraulic arm is raised, the carriage travels two feet. The hydraulic cylinder, sheave, chains, channel and carriage together form one arrangement for a trestle transport mechanism.

An optional pair of hands is provided on one or both sides of the trestle. The hands are placed at the end of vertically or rotationally moveable lifting arms. During a pick-up operation, pipe is rolled from a pipe rack onto the hands. The hands are then raised above the height of the trough and tilted inward so that the pipe gravitationally rolls into the trough.

Another optional feature of the pipe-handling machine provides a means for ejecting pipe from the trough and onto the hands in order to return pipe to the pipe rack, such as during a laydown operation. In one arrangement, the pipe ejection structure comprises a pair of plates having angled wings. The plates are raised via hydraulic arms, causing the pipe to be lifted from the trough. The wings are angled such that a lifting of the pipe also causes the pipe to roll to one side of the trestle, whereupon the pipe joint is received by the hands. The pipe joint is then rolled onto or otherwise delivered to the adjoining pipe rack.

A unique hydraulic circuitry for the machine is also provided herein. In one embodiment, the circuitry includes a position valve that is mechanically actuated when the trestle is on the catwalk. When the trestle is in its lower position on the catwalk, hydraulic circuitry allows operation of the pipe loading and pipe transfer mechanisms, i.e., the lifting hands and the ejection plates. Hydraulic power is removed from the translation apparatuses that move the trough carrier relative to the trestle, and the trough relative to the trough carrier. However, when the trestle is raised by actuation of the hydraulic cylinder within the ramp frame, the circuitry functions are reversed. Thus, when a section of pipe is being raised to the rig floor, the pipe loading and pipe transfer systems cannot be employed, ensuring that pipe will not be ejected from the trough. A second position valve is provided at the top of the ramp. When the upper position valve is reached, the trough carrier/trough transport mechanisms are powered. Preferably, the telescoping ramp cylinders for the trestle transport mechanism are disengaged until the trough and trough carrier are retracted.

As noted, the machine of the present invention is highly mobile. The machine is configured so that the trough and trough carrier may be nested within the trestle. A rear portion of the trestle is foldable over the trestle body. Further, the ramp frame may be folded over the trestle. Using a winch line, the trestle and accompanying machine components may be slidably transferred from a flat-bed trailer to the catwalk, and vice versa. The trestle and attached machine components are rotated into position for use or for transport. Accompanying power sources, such as diesel engines, hydraulic fluid, e.g., oil and canisters may also be carried on the trailer via a skid.

BRIEF DESCRIPTION OF THE DRAWINGS

So that the manner in which the above recited features of the present invention are attained and can be understood in detail, a more particular description of the invention, briefly summarized above, may be had by reference to the drawings that follow. FIGS. 1 through 16D are provided. It is to be noted, however, that the attached Figures illustrate only certain embodiments of this invention, and are not to be considered limiting of its scope.

FIG. 1 is a perspective view of a pipe-handling machine constructed in accordance with this invention, in one embodiment. In this view, the pipe-handling machine has been moved to a rig site, and a trestle of the machine is positioned on a catwalk. A portion of a drilling rig is shown. The trestle is in its lower position, but the inclined mast, or "ramp," is raised to position against a drilling rig. The pipe-handling machine is shown somewhat schematically in this view to demonstrate contextual use for the machine.

FIG. 2 is an enlarged side view of the pipe-handling machine of FIG. 1. The ramp has been unfolded into position against the drilling rig. The trestle is again in its lower position, ready to be carried up the inclined ramp.

FIG. 3 is another side view of the pipe-handling machine of FIG. 2. In this view, the trestle has been raised by a carriage to the top of an inclined ramp. A trough carrier transport mechanism is being used to both raise and translate forward the trough carrier from the trestle. It can be seen that a tubular has been delivered to the rig floor.

FIG. 4 shows a perspective view of a base frame as might be used to provide lateral support to the trestle, in one embodiment. Channels are seen in base frame bars for receiving the rear portion of the trestle.

FIGS. 4C(1)-(3) each show another side view of a portion of the pipe-handling machine of FIGS. 1 and 2. Here, an alternate ramp rotation mechanism is employed for rotating the ramp. In FIG. 4C(1), the ramp is folded over the trestle, while in FIG. 4C(3), the ramp is fully extended. FIG. 4C(2) shows an intermediate position of the ramp.

FIG. 7 provides a top view of the frame for the inclined ramp of FIG. 6. Visible in this view is the top of the frame, including portions of a sheave and carriage within the frame.

In FIG. 9A, the stabilizing arm is affixed near the bottom of the frame on a side.

In FIG. 9B, the stabilizing arm is affixed near the top of the trestle frame on a side.

FIG. 11 presents a top view of the trough of FIG. 2A. Visible in this view are two pairs of lifting plates. One pair is for ejecting a pipe to one side of the trough, while the other pair is for ejecting a pipe to the other side of the trough.

FIG. 13 provides a circuit diagram for a hydraulic system as might be used during operation of the pipe-handling machine of FIG. 1, in one embodiment.

FIG. 14 provides a circuit diagram for a hydraulic system of the pipe-handling machine of FIG. 1, in an alternate embodiment.

Figure 15B:
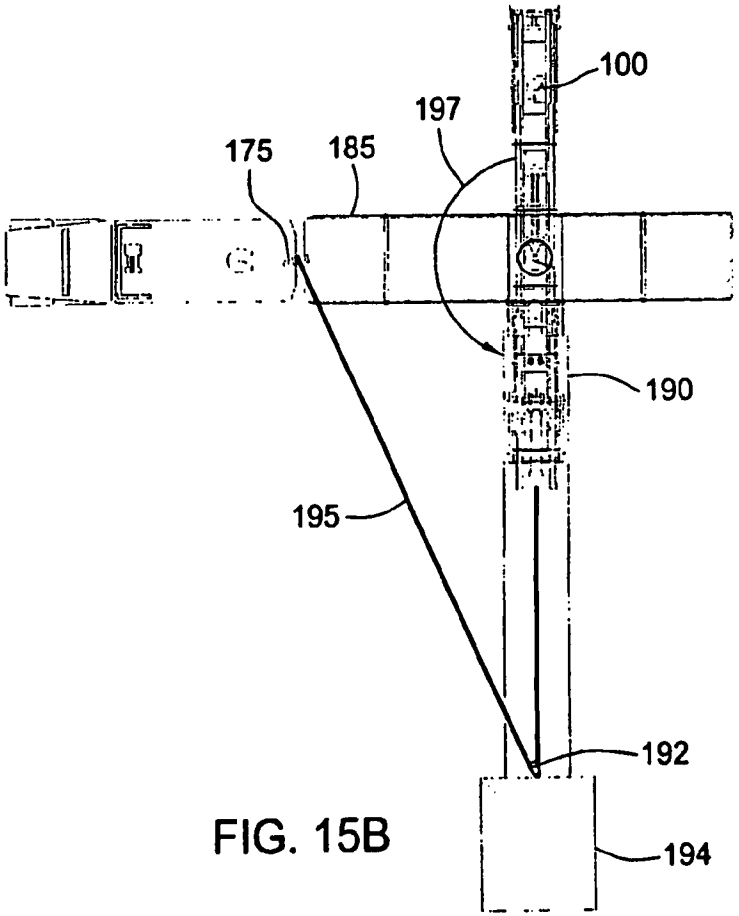
Figure 15A:
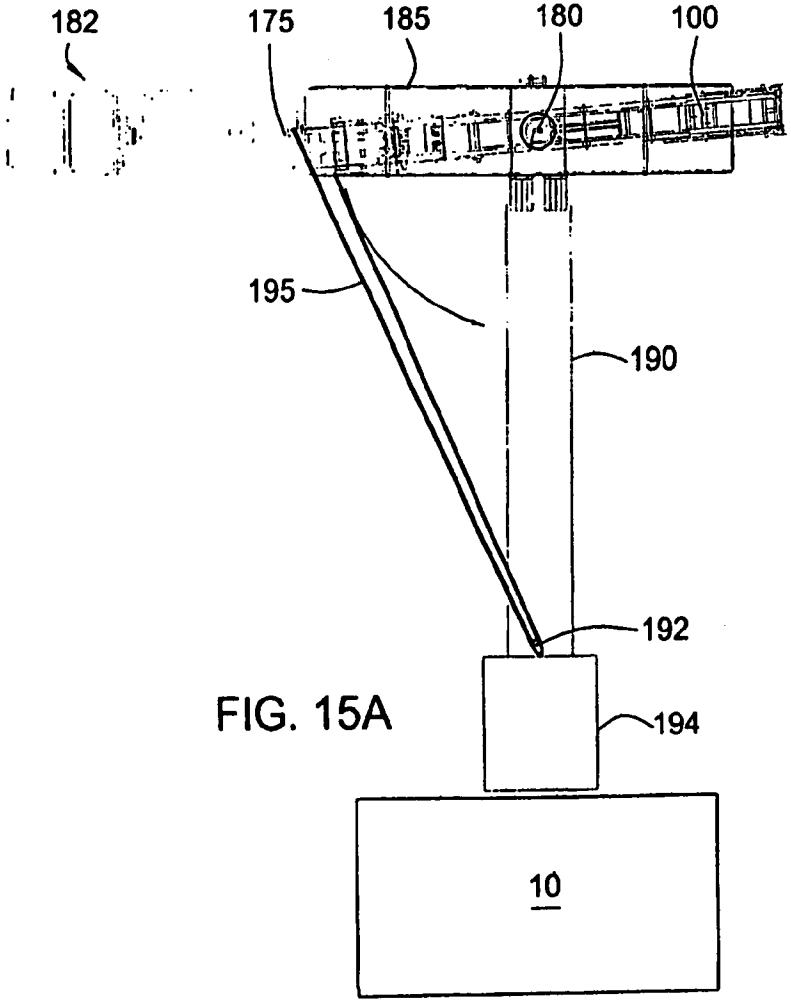
Figure 15C:
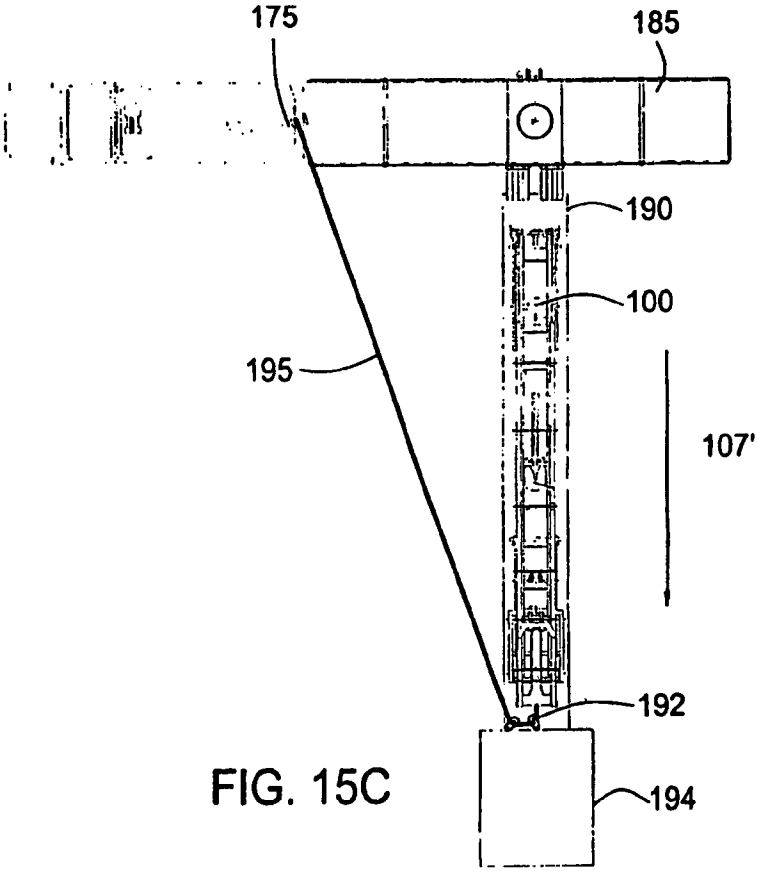

Each of FIGS. 15A through 15C presents a top view of a pipe pickup and laydown machine being transferred from a flatbed trailer onto a catwalk at a rig site. The pipe-handling machine and the rig are shown schematically.

In FIG. 15A, the pipe-handling machine is resting on the flatbed trailer of a truck. The flatbed trailer is positioned adjacent a catwalk of a drilling rig. The bed of the truck and the machine are positioned essentially normal to the catwalk.

In FIG. 15B, the pipe-handling machine has been rotated to a position essentially parallel to the catwalk using a winch line.

In FIG. 15C, the pipe-handling machine has been pulled onto the catwalk. A winch line is visible pulling the machine.

Each of FIGS. 16A through 16D presents a top view of the pipe pickup and laydown machine of FIGS. 15A-15C. The machine has completed the pipe pick-up and laydown operations, and is now ready to be taken from the drilling site. In these drawings, the machine is being transferred from the catwalk back to the flatbed trailer. The pipe-handling machine and the rig are again shown schematically.

Figure 16A:
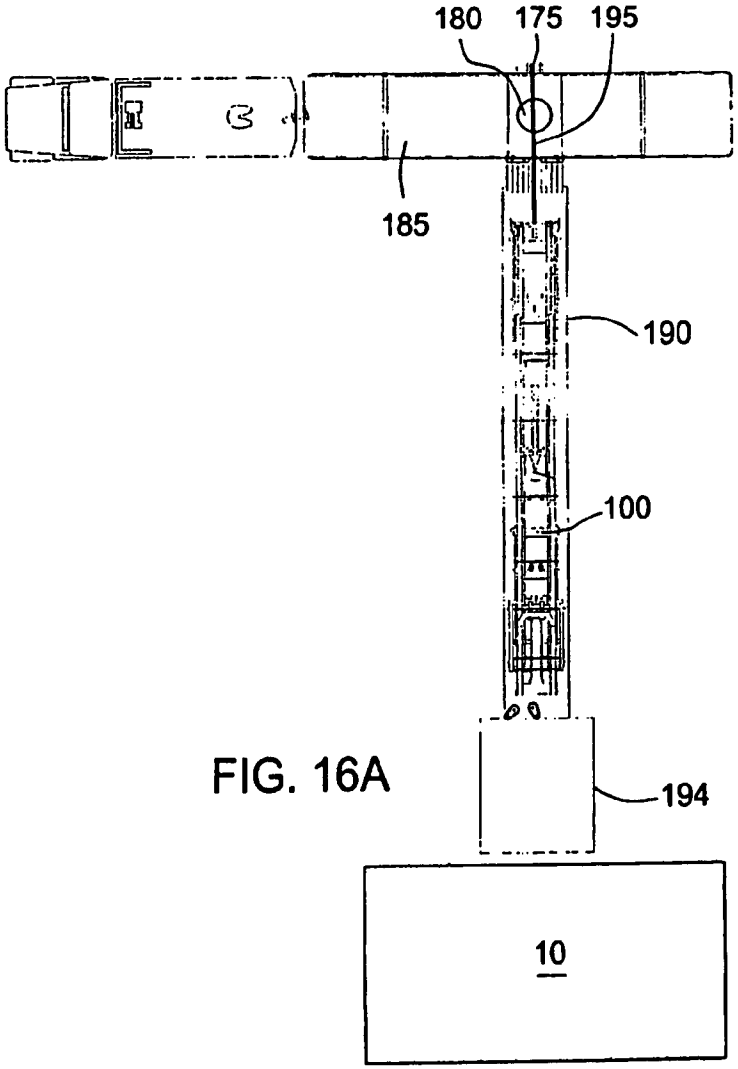

In FIG. 16A, a winch line has been configured for pulling the machine back onto the flatbed trailer.

Figure 16C:
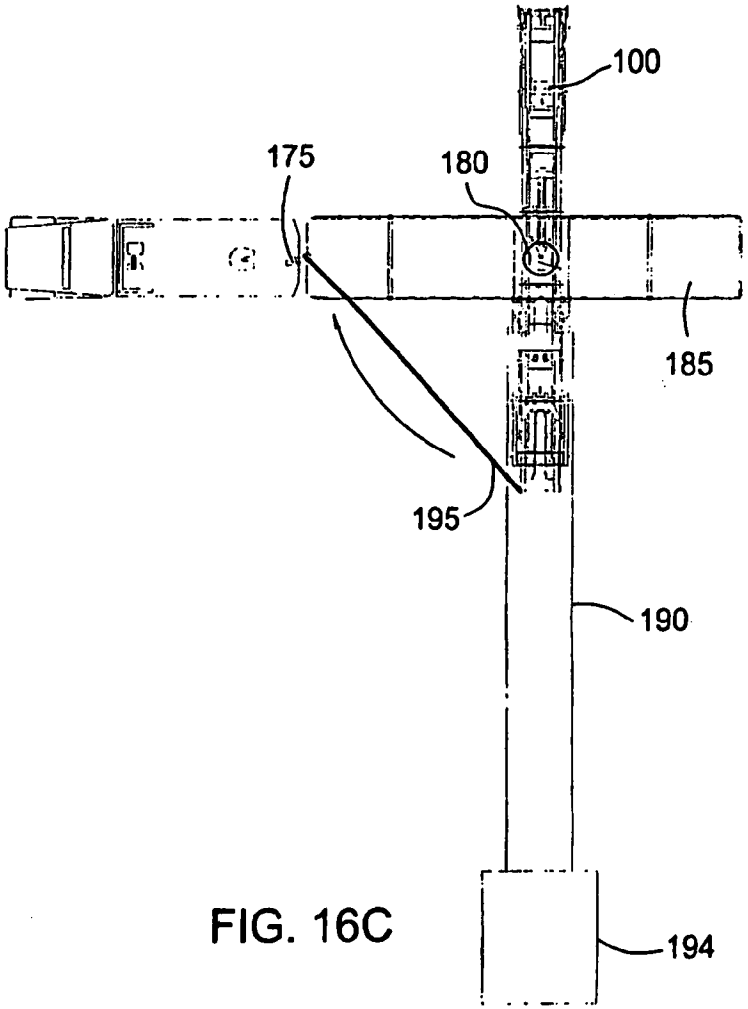
Figure 16B:
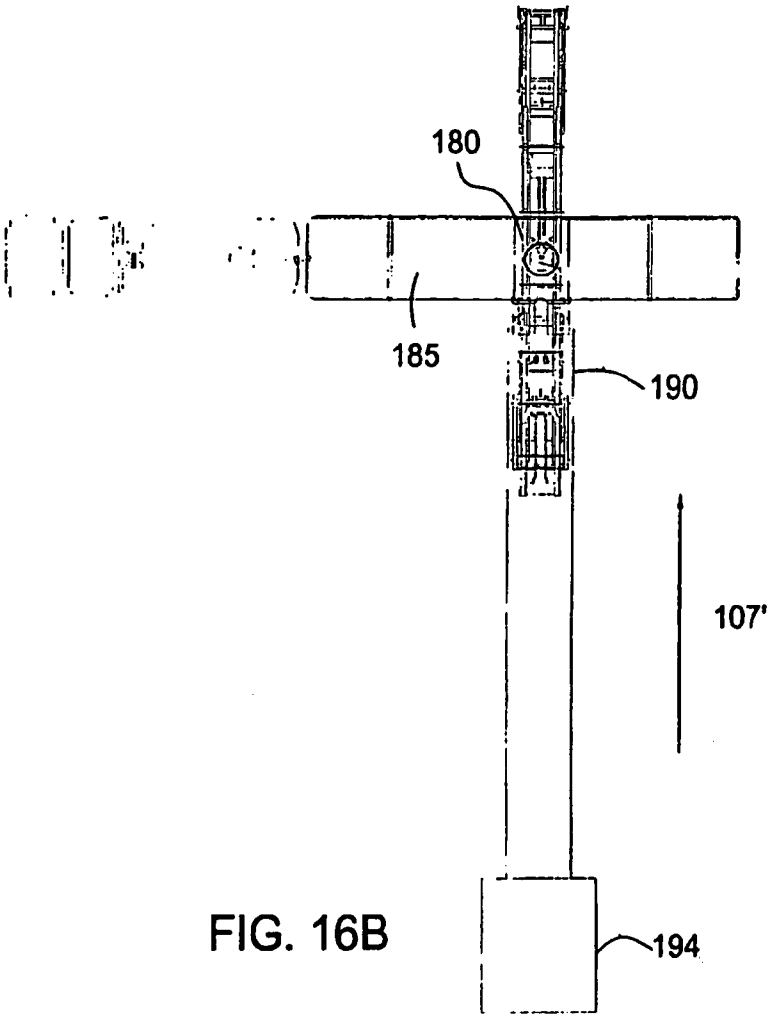

In FIG. 16B the pipe-handling machine has been pulled onto the trailer, but is still oriented perpendicular to the bed.

FIG. 16C shows the winch line being reconfigured so that the pipe-handling machine can be rotated into proper orientation for transport on the trailer.

Figure 16D:
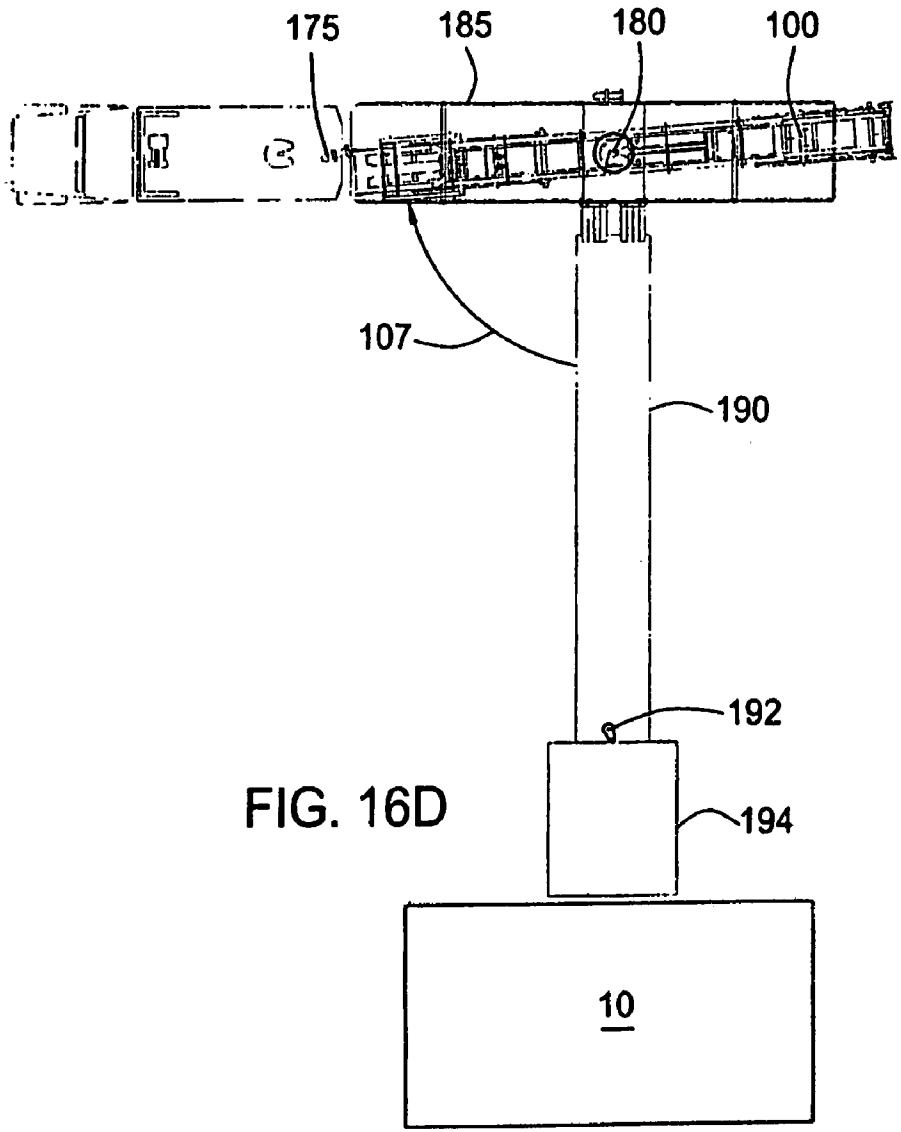

Finally, in FIG. 16D, the pipe-handling machine of FIG. 16C has been properly positioned on the flatbed trailer, and is ready to be transported away from the drill site.

DETAILED DESCRIPTION OF THE PREFERRED EMBODIMENT

Figure 1:
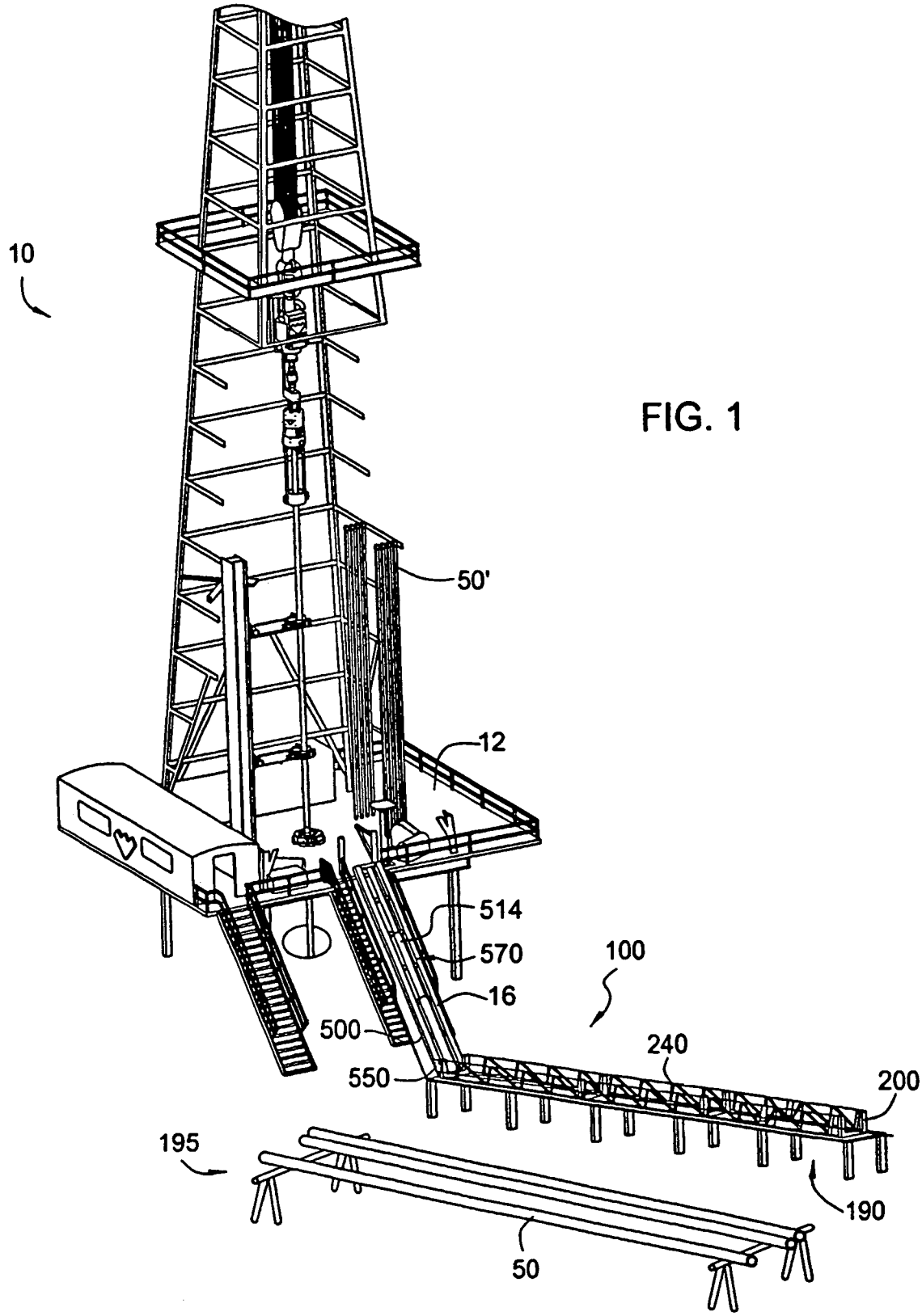

FIG. 1 presents a perspective view of a pickup and laydown system, or "pipe-handling machine" 100 constructed in accordance with the present invention, in one embodiment. In this view, the pipe-handling machine 100 has been moved to a rig site, and is set up adjacent to a drilling rig 10. A portion of the drilling rig 10 is visible in FIG. 1, including the rig floor 12. The rig 10 shown is a land rig having a rig floor 12 that is between 16 and 30 feet in height above the ground. However, it is understood that the pipe pick-up and laydown machine 100 of the present invention may be used with either land or offshore rigs (not shown), and with rigs of various sizes and configurations. In addition, the pipe-handling machine 100 may be used in connection with any wellbore operation platform which handles pipe. The pipe-handling machine 100 of FIG. 1 is shown somewhat schematically to demonstrate one contextual use for the machine 100.

The pipe-handling machine 100 is designed to receive a joint of pipe 50 from a pipe rack 195 at ground level, and deliver it to the rig floor 12 for further stacking and use during a drilling or workover operation. Reciprocally, the pipe-handling machine 100 is able to receive pipe 50' from the rig floor 12, and return it back to ground level where it can be expelled onto the pipe rack 195.

Figure 2:
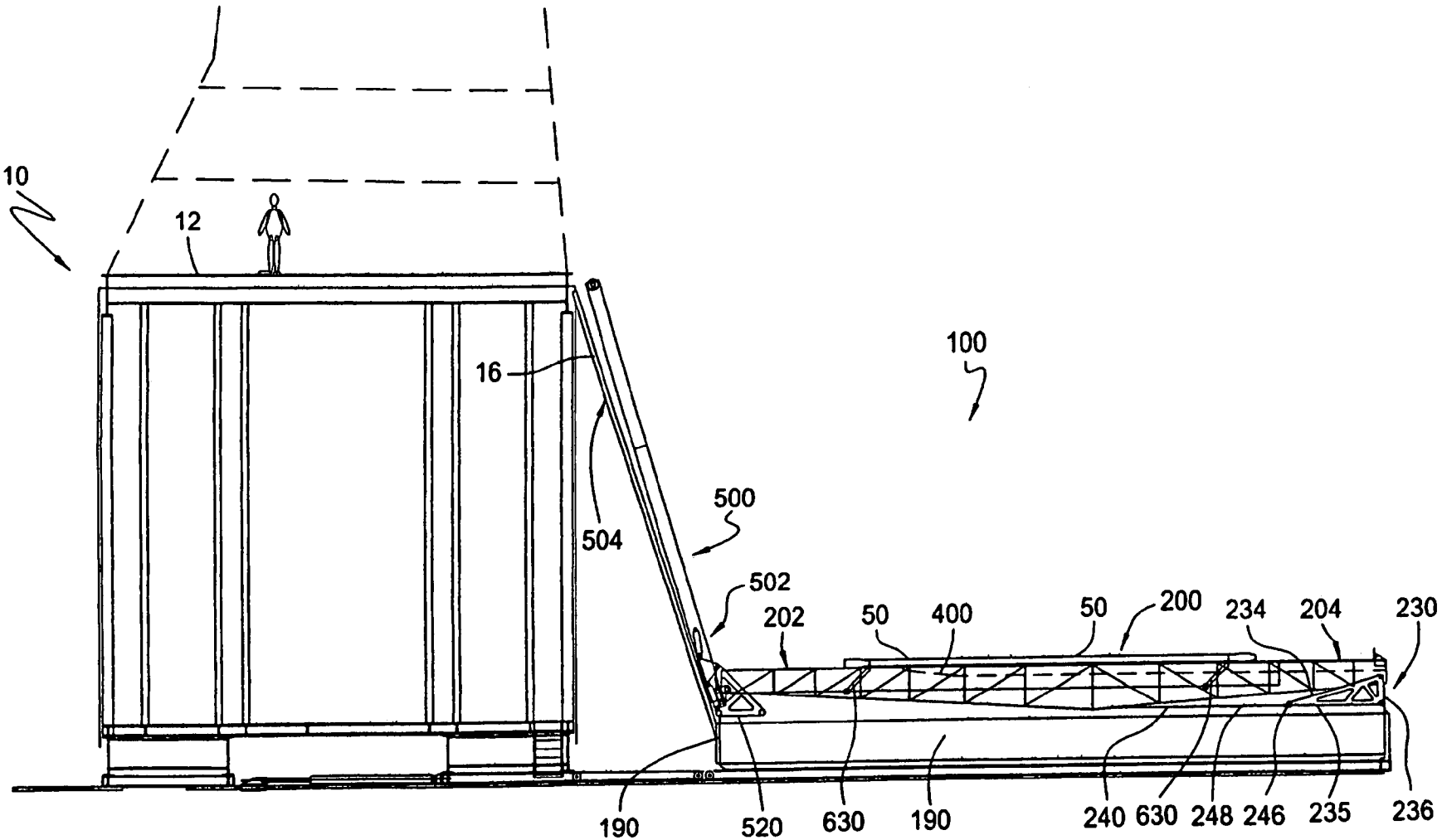

FIG. 2 shows a side view of the pipe-handling machine 100 of FIG. 1. A lower portion of a drilling rig 10 is also shown somewhat schematically to place the machine 100 in context. In the side view of FIG. 2, two members of the machine 100 are discernable—a trestle 200 and a ramp 500. Two other members of the machine 100—a trough carrier 300 and a trough 400—are disposed within the trestle 200 and are not separately discernable in the views of FIGS. 1 and 2.

The trestle 200 of the pipe-handling machine 100 serves as a cradle for the machine 100. In the views shown in FIGS. 1 and 2, the trestle 200 is in an essentially horizontal position. When situated for operation, the trestle 200 has a forward portion 202 proximate to the drilling rig 10, and a rear portion 204 distal to the drilling rig 10. Preferably, the trestle 200 is placed on the top of a catwalk 190 upon delivery to a rig site. Those of ordinary skill in the art will appreciate that most drilling sites, especially those on land, include a catwalk that serves as a staging area for transferring pipe 50 from various pipe racks (such as the pipe rack 195) to the rig floor 12. Typically, the catwalk 190 has an elevated solid platform that is of approximately the same height as the pipe racks.

Figure 2A:
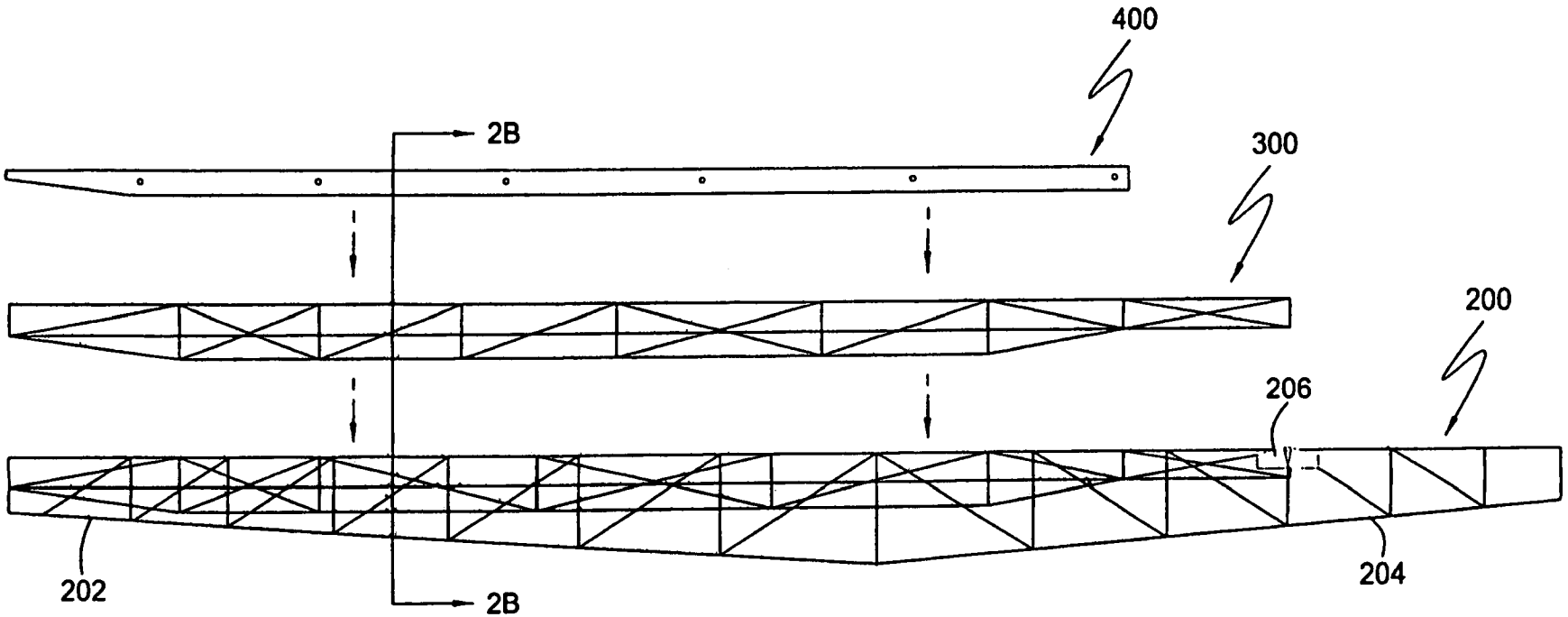
FIG. 2A is a side view of a trestle from the pipe-handling machine of FIG. 2. A trough carrier frame and trough frame are shown exploded above the trestle frame. Arrows demonstrate that the trough is configured to reside within the trough carrier, and the trough carrier is configured to reside within the trestle.
Figure 2B:
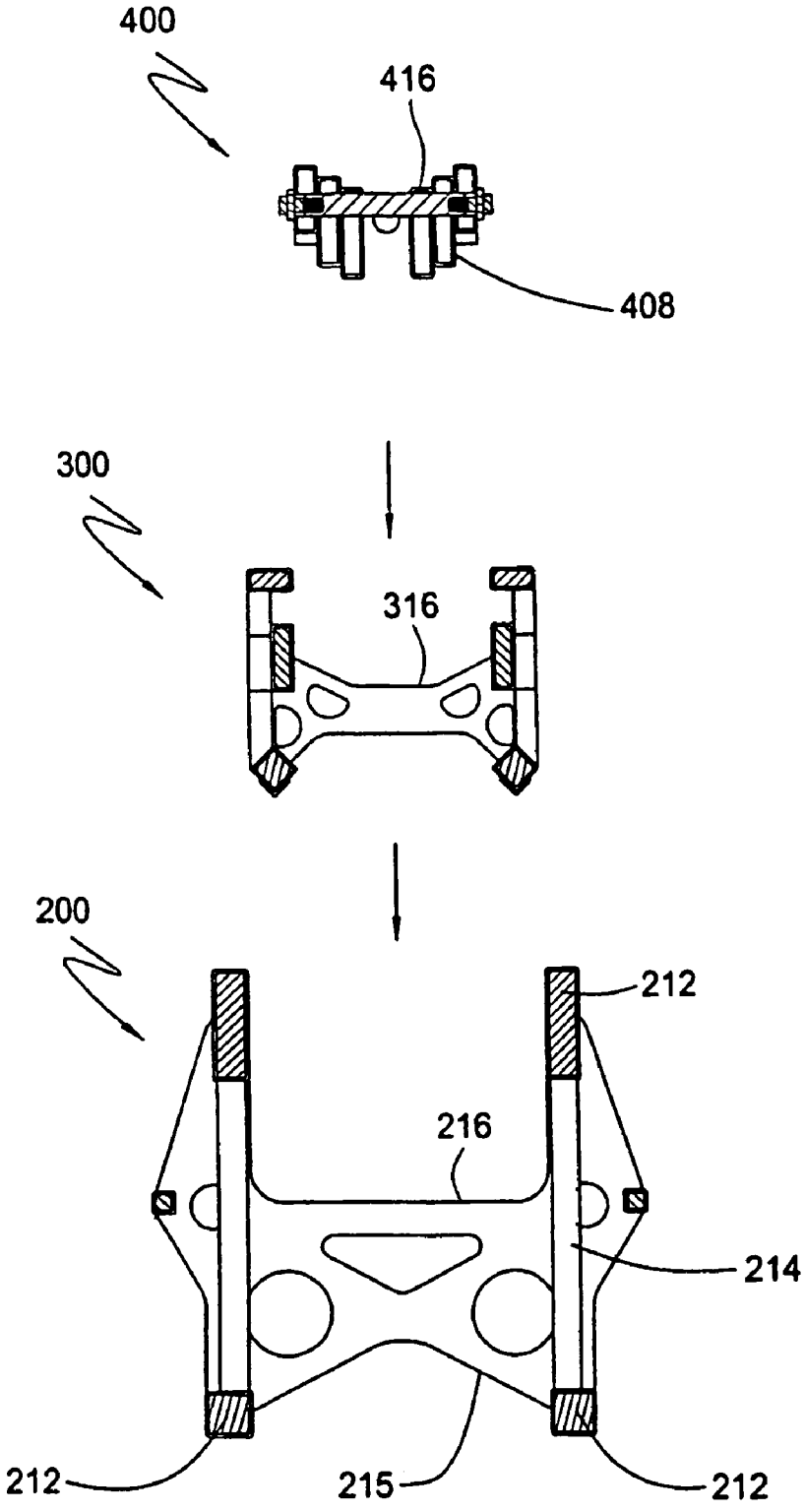
FIG. 2B presents cross-sectional views of the trestle, the trough carrier, and the trough of FIG. 2A. The views are taken across line 2B-2B of FIG. 2A. These views better demonstrate that the trough is configured to reside within the trough carrier, and the trough carrier in turn is configured to reside within the trestle.

The trestle 200 defines an elongated frame structure having a plurality of structural support members. Various structural support members are seen best in the cross-sectional view of FIG. 2B. First, longitudinal support members 212 are provided. Longitudinal support members 212 extend along the longitudinal axis of the trestle 200, on both the top and the bottom of the trestle 200. The longitudinal support members 212 are seen in FIG. 2B, in cross-section. The longitudinal support members 212 are secured together by vertical support members 214 and by horizontal frame members 215. Together, the various support members 212, 214, and 215 form an open top, U-shaped truss. Thus, the trestle 200 includes an upper receiving surface, shown at 216 in FIG. 2B. In one aspect, the upper surface 216 is concave in configuration.

The trestle 200 houses two separate frame members—a trough carrier 300 and a trough 400. The trough carrier 300 and the trough 400 are not visible in FIG. 1 or 2 as they are nested within the trestle 200. However, the trough carrier 300 and trough 400 are visible in FIGS. 2A and 2B. FIG. 2A is a side view of the trestle 200 from the pipe-handling machine 100 of FIG. 2. A trough carrier 300 and trough 400 are shown exploded above the trestle 200. Arrows demonstrate that the trough 400 is configured to reside within the trough carrier 300, and the trough carrier 300 is configured to reside within the trestle 200.

FIG. 2B presents cross-sectional views of the trestle 200, the trough carrier 300, and the trough 400 of FIG. 2A. The views are taken across line 2B-2B. These views better demonstrate that the trough 400 is configured to reside within the trough carrier 300, and the trough carrier is configured to reside within the trestle. More specifically, the trough carrier 300 is received upon the upper receiving surface 216 of the trestle 200, while the trough 400 is received upon an upper receiving surface 316 of the trough carrier 300. Features of the trough carrier 300 and the trough 400 will be discussed in more detail below.

It is noted at this point that the overall length of the pipe-handling machine 100 is preferably dimensioned to be received upon and transported by a flatbed trailer without necessity of a special DOT permit. In one aspect, and to accomplish a shortening of the overall length of the pipe-handling machine 100, the rear portion 204 of the trestle 200 may be folded over. The rear portion 204 is folded over by means of a pin connection 206. In this respect, the rear portion 204 is joined to the trestle 200 by a pin 206 that allows the rear portion 204 to move from a first lower position in the longitudinal plane of the trestle 200. The pin 206 is seen in FIG. 4A. In one arrangement, the rear portion 204 is approximately 8 feet in length.

FIG. 4A presents yet another side view of the pipe-handling machine 100 of FIG. 2. In this view, the trestle 200 is again in its lower position. The rear portion 204 of the trestle 200 is being folded over in order to shorten the length of the trestle 200 for transportation. Arrow 207 shows progressive rotational movement of the rear portion 204 as it is folded into the trestle 200.

It is preferred that the pipe-handling machine 100 be positioned on a base frame. A base is shown at 240 in FIG. 2 and FIG. 4A. The base 240 is shown schematically as a line in FIG. 2, and is seen placed on top of the catwalk 190. However, in FIG. 4, the base 240 is seen in perspective view. In one arrangement, the base 240 comprises a pair of parallel bars 248 that serve as a guide system for the trestle 200. In this respect, the guide system slidably receives the rear portion 204 of the trestle 200 as the forward end 202 moves upward towards the rig floor 12 during tool 100 operation. Preferably, the guide system bars 248 define parallel channels. Vertical bars 249 are also provided. As will be described later in connection with FIGS. 10A and 10B, the vertical bars 249 serve as support members for a stabilizing arm 610 or, alternatively, a lifting arm 620.

The pipe pick-up and laydown machine 100 next comprises an inclined ramp 500. In FIGS. 1 and 2, it can be seen that the ramp 500 is pivotally connected to the trestle 200 at the trestle's front end 202. The ramp 500 has been inclined against the rig 10. Preferably, the ramp 500 is supported by a V-Door ramp, as shown at 16 in FIGS. 1 and 2.

Figure 6A:
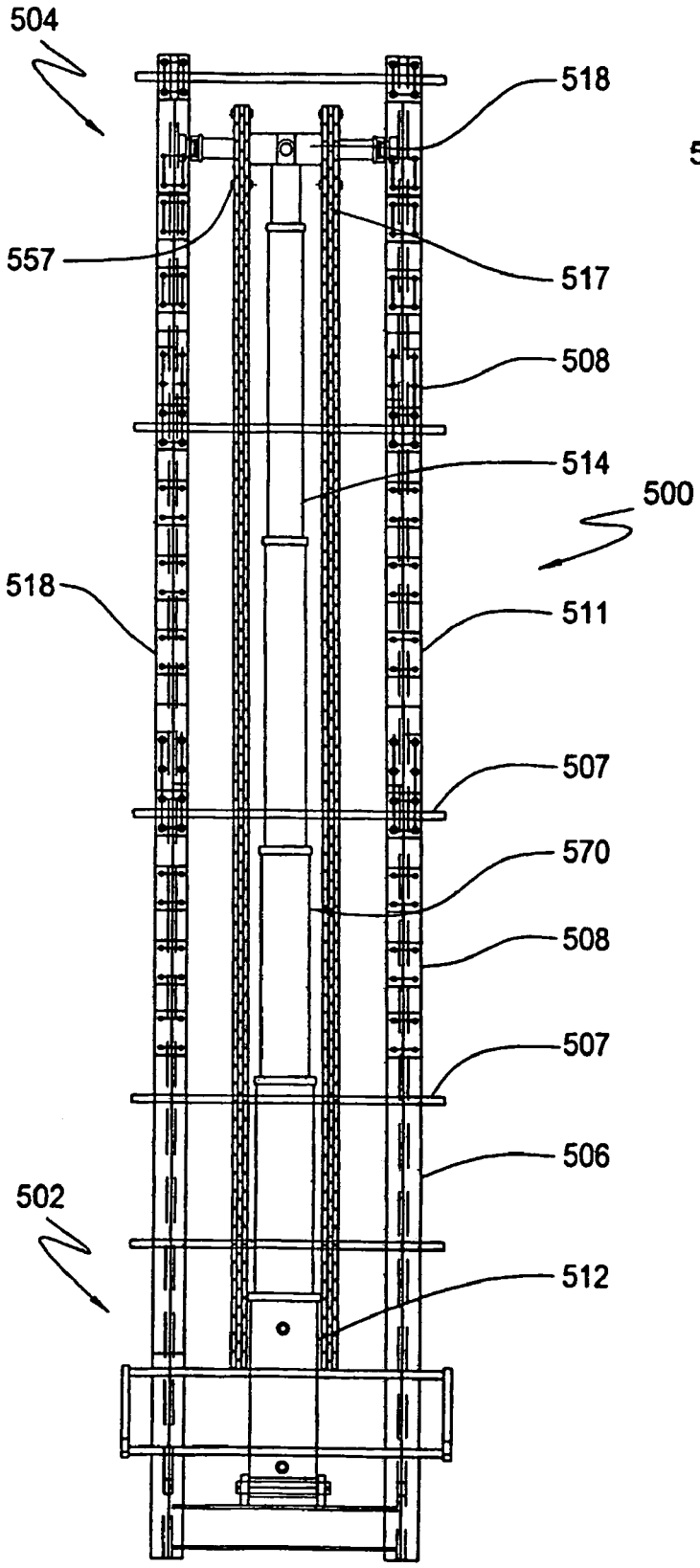
FIG. 6A shows a front view of the frame for the inclined ramp in the pipe-handling machine of FIG. 1. In the arrangement shown in FIG. 6A, modular extensions have been mounted into the frame.
Figure 6B:
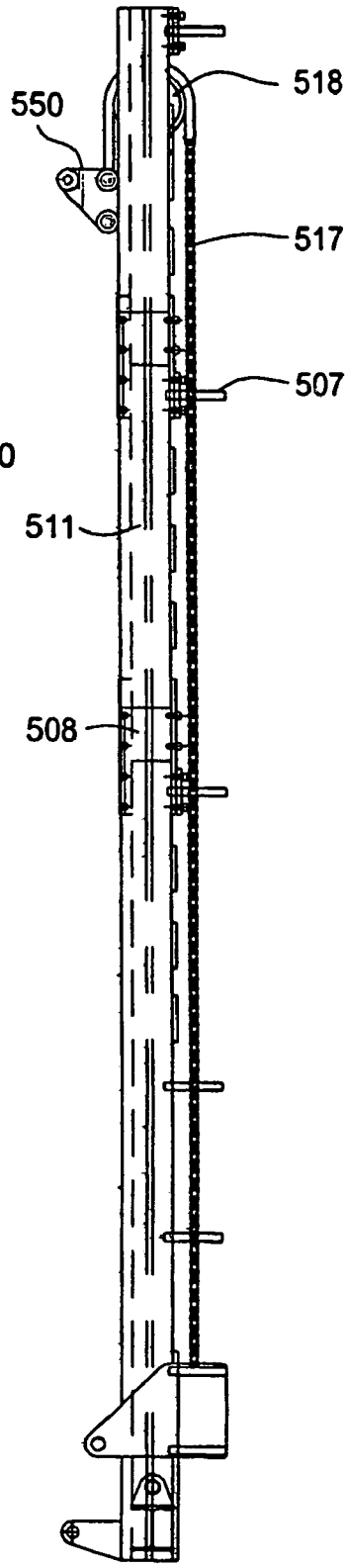
FIG. 6B is a side view of the frame for the inclined ramp of FIG. 6A.

The ramp 500 defines an essentially U-shaped frame 506 made up of a plurality of beams and lattices. Transverse stabilizing members 507 are included in the frame 506. FIG. 6A presents a front view of a frame in one embodiment. FIG. 6B presents the frame of FIG. 6A in side view. An optional modular extension 511 is shown included in the frame 506, connected by pads 508. The modular extensions 511 permit the ramp 500 to be lengthened in order to accommodate rig floors 12 of various heights.

The ramp 500 has an upper end 504 and a lower end 502. Preferably, the lower end 502 is pivotally connected to a forward end 242 of the base 240 (seen in FIG. 4). This allows the ramp 500 to be rotated between a folded over position for transport, and an unfolded position for operation. Movement of the ramp 500 between these positions is shown at arrow 507 in FIG. 4A.

Figure 3:
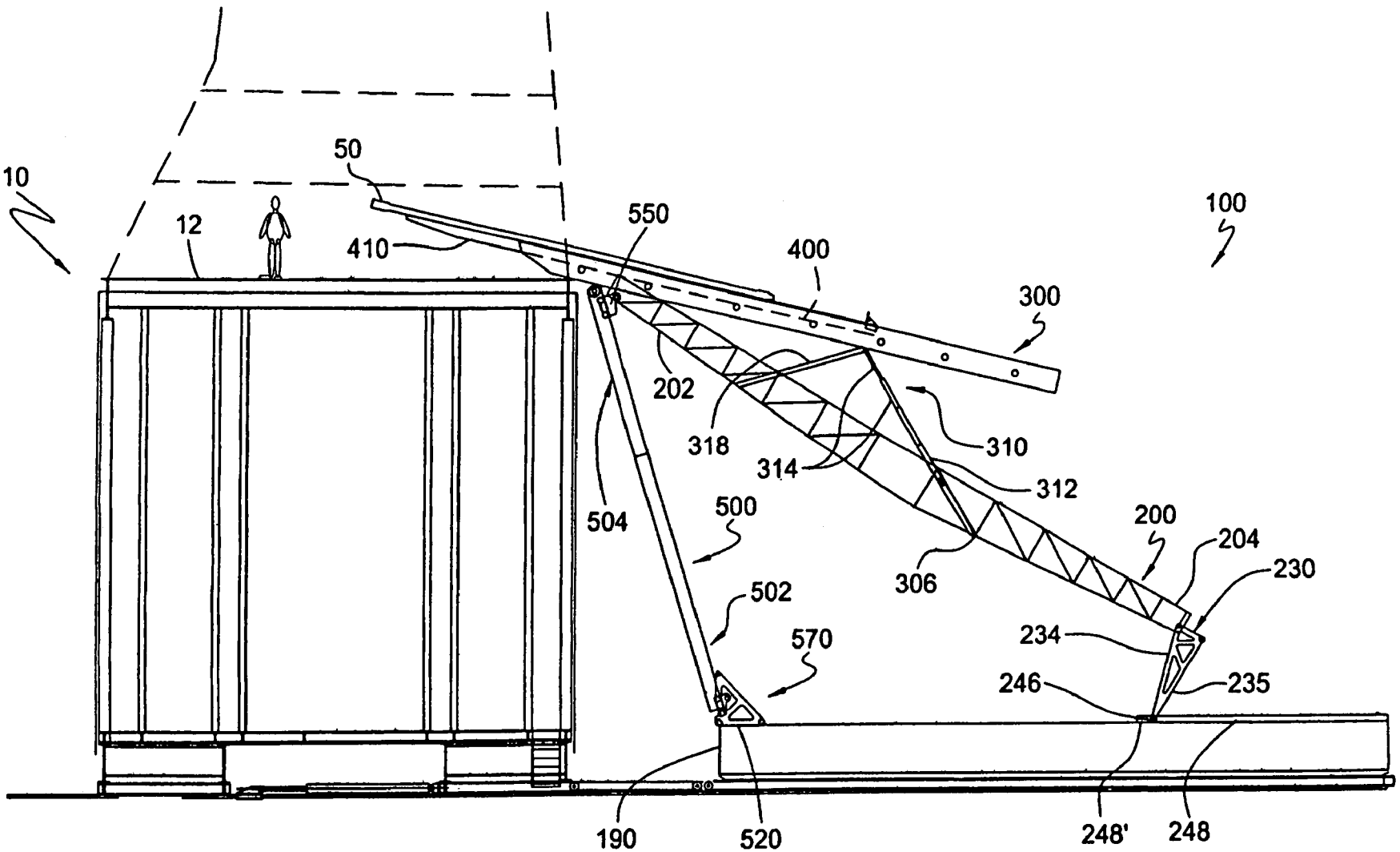

FIG. 3 presents another side view of the pipe-handling machine 100 of FIG. 2. In FIG. 3, the inclined ramp 500 is in its extended position against the rig 10. Preferably, the ramp 500 is rested against an already-in-place V-door ramp 16. In this view, the trestle 200 has been raised to the top of the inclined ramp 500. A tubular 50 has been delivered to the rig floor 12.

Various arrangements may be provided for the pivoting connection between the ramp 500 and the base 240. In FIG. 3, one embodiment for a ramp rotation mechanism 510 is provided. The ramp rotation mechanism 510, is best seen in FIG. 4A. The ramp rotation mechanism 510 includes at least one hydraulic cylinder 528 and a pair of triangular frames 520, 530. The hydraulic cylinder 528 and the triangular frames 520, 530 are positioned at the lower end 502 of the ramp 500. The lower end of the ramp 500 is designated in FIG. 2 by reference arrow 502. As shown in FIG. 2, the lower end 502 is pivotally pinned to ramp rotation frames 520 (only one shown). The pivoting connection allows the ramp 500 to pivot relative to the trestle 200.

The ramp rotation frame 520 presented in FIGS. 2 and 4A is triangular, though other geometries may be employed. The ramp rotation frame 520 resides at the same level as the lower position of the trestle 200, such as immediately above or on the catwalk 190. In one arrangement, the hydraulic cylinder 528 (shown most clearly in FIG. 4B) is placed such that the fixed end of the respective cylinder 528 is pinned to a first point 522 in one of the rotation frames 520. The cylinder 528 includes a telescoping arm 529 that is pinned to a first point 532 of a separate A-frame 530. A vortex 534 of the A-frame 530 is pinned to a second point 524 in the ramp rotation frame 520.

Actuation of the hydraulic cylinder 528 causes the inclined ramp 500 to be moved between extended and retracted positions. As noted above, the ramp 500 is in its extended position in FIGS. 2 and 3. FIG. 4A is provided to show the ramp 500 being rotated to its folded over, or retracted position. Again, movement of the ramp 500 from its extended position to its retracted position is shown at arrow 507 in FIG. 4A. To retract the ramp 500, the telescoping arm 529 is extended outward from the hydraulic cylinder 528. FIG. 4B shows the telescoping arm 529 extended, causing ramp 500 to be folded over the trestle 200.

FIG. 4B is a side view of the pipe handling machine of FIG. 4A. In this view, the rear portion of the trestle 200 has been folded over the trestle 200, and the inclined ramp 500 has also been folded over the trestle 200. The foldable features allow the overall length of the machine 100 to be shortened for over-the-road transport purposes. Preferably, the length of the machine 100 in its folded state is less than 45 feet to avoid permitting requirements from a regulatory transportation department.

An alternate arrangement for a ramp rotation mechanism 510' is shown in FIGS. 4C(1)-(3). FIGS. 4C(1), 4C(2) and 4C(3) each shows a side view of the alternate ramp rotation mechanism 510'. In FIG. 4C(1), the ramp 500 is folded over the trestle 200, while in FIG. 4C(3), the ramp 500 is fully extended. FIG. 4C(2) shows an intermediate position of the ramp 500.

In the alternate arrangement shown in FIGS. 4C(1)-(3), a pair of frame members 520', 530' is again provided. The first frame member 520' is triangular, while the second frame member 530' is integral to the ramp 500 itself. Hydraulic cylinders 528, 538 sequentially act on the two frame members 520', 530' in order to rotate the ramp 500. Hydraulic cylinder 528' acts on the first frame member 520', while hydraulic cylinder 538' acts on the second frame member 530'.

The first hydraulic cylinder 528' has a first end 522' pivotally connected to the trestle 200, and a second end 524' pivotally connected to the first frame member 520'. Likewise, the second hydraulic cylinder 538' has a first end 532' pivotally connected to the trestle 200, and a second end 534' pivotally connected to the second frame member 530'. The second hydraulic cylinder 538' has an intermediate pivoting connection 536' as well.

Referring to FIG. 4C(1), the first hydraulic cylinder 528' is fully extended, while the second hydraulic cylinder 538' is fully retracted. In this position, the ramp 500 is folded over the trestle 200. In FIG. 4C(2), the first hydraulic cylinder 528' has been fully retracted, while the second hydraulic cylinder 538' remains fully retracted as well. In this position, the ramp 500 is being rotated into an upright position. Finally, in n FIG. 4C(3), the first hydraulic cylinder 528' remains fully retracted, while the second hydraulic cylinder 538' has been extended. In this position, the ramp 500 is rotated further into a position where it can lean against a V-Door ramp (not shown). The use of separately linked and sequentially operated cylinders 528', 538' allows for a greater angular range of motion for the ramp 500.

In one embodiment, the ramp 500 is extendable in height. To this end, the ramp 500 is fabricated from modular frame portions 511, e.g., three or more, that are connectible end-to-end. The addition of modular frame portions (shown at 511 in FIG. 6A) serves to selectively lengthen the frame 500, thereby allowing the ramp 500 to be adapted to different rig heights. The drilling company provides the rig height, catwalk, and V-ramp dimensions. This informs the operator of the pipe-handling machine 100 with the information needed to calculate the needed length of the inclined ramp 500.

As noted in connection with FIGS. 2A and 2B, the pipe pick-up and laydown machine 100 also comprises a trough carrier 300. The trough carrier 300 defines an elongated frame made up of a plurality of beams and lattices. The trough carrier 300 has an open top for receiving a trough 400. The open top forms an upper receiving surface 316 for receiving the trough 400. The trough carrier 300 resides within the U-shaped trestle 200 on the upper receiving surface 216, and is nested between the trestle 200 and the trough 400.

The trough carrier 300 is connected to the trestle 200 by means of a trough carrier transport mechanism 310. The trough carrier transport mechanism 310 is provided for selectively moving the trough carrier 300 relative to the trestle 200. One embodiment of a trough carrier transport mechanism 310 is shown in FIG. 3. Preferably, the trough carrier transport mechanism 310 defines a hydraulically operated cylinder 312 having at least one telescoping section 314. The hydraulically operated cylinder 312 is pivotally fastened to the trestle 200 proximate to the rear portion 204 of the trestle 200 by a pin 306. The hydraulically operated cylinder 312 is oriented so that the telescoping section(s) 314 extend outward towards the forward portion 202 of the trestle 200. Thus, extension of the telescoping section(s) 314 serves to extend the trough carrier 300 partially out of the trestle 200 and towards the drilling rig 10. A brace 318 is also provided to assist the telescoping section(s) 314 in lifting the trough carrier 300. The brace 318 is pivotally pinned to the trestle 200 at one end, and to the telescoping section 314 at the other.

FIG. 3 is another side view of the pipe-handling machine 100 of FIG. 1. In this view, the trestle 200 has been raised by a carriage 550 to the top of the inclined ramp 500. The trough carrier 300 can be seen raised relative to the trestle 200. The trough carrier transport mechanism 310 is being used to both rotationally raise and translate forward the trough carrier 300 from the trestle 200. It can also be seen in FIG. 3 that a tubular 50 has been delivered to the rig floor 12.

A variety of embodiments is possible for the trough carrier transport mechanism 310. Three additional embodiments are shown in FIGS. 5A, 5B and 5C, respectively.

Figure 5A:
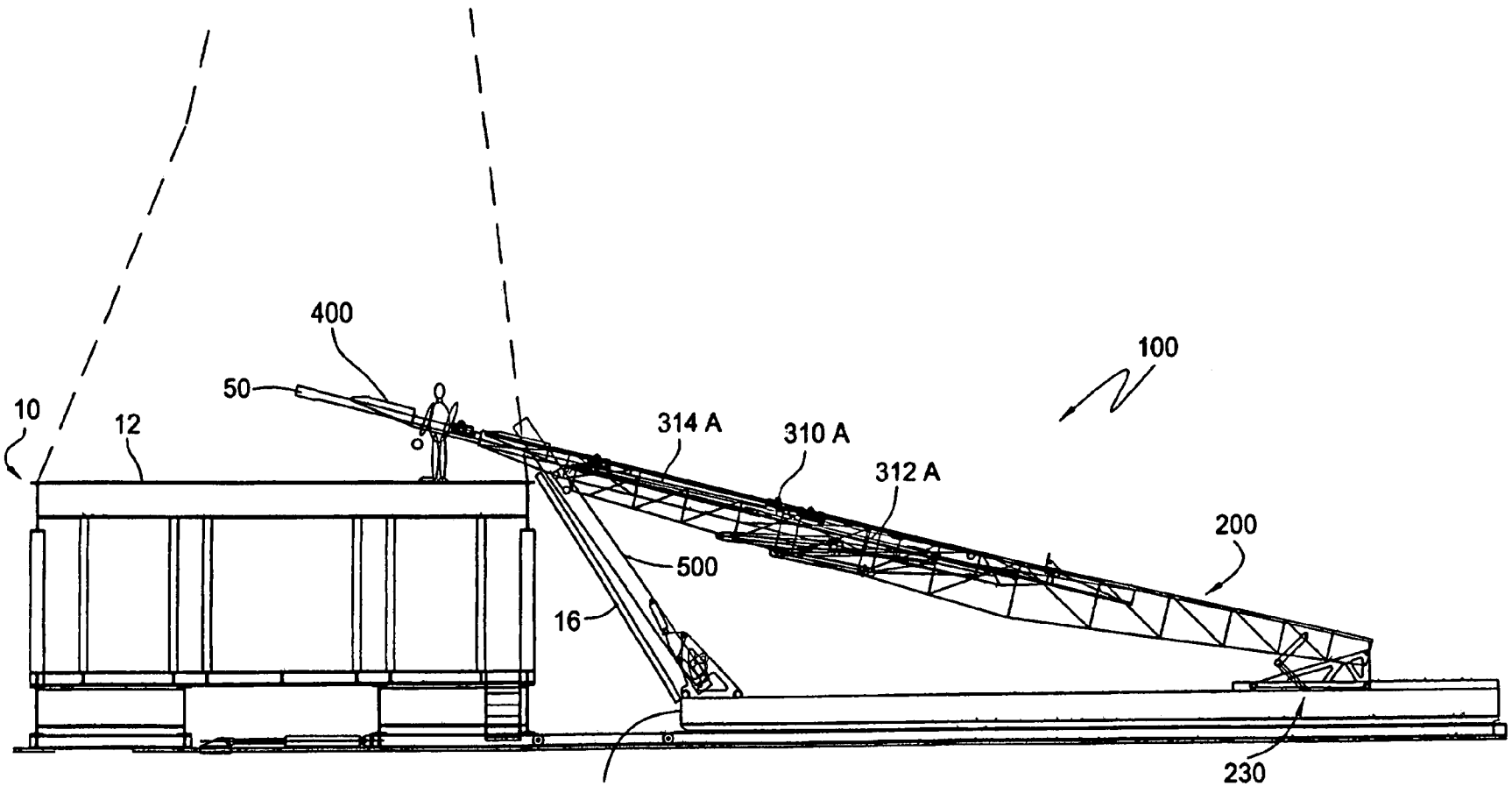
FIG. 5A provides a side view of the pipe-handling machine of FIG. 2, with the trestle shown in an upper position in order to deliver a joint of pipe onto the drilling rig floor. The rig floor height in this Figure is lower than the rig floor height of FIG. 3. A trough carrier transport mechanism is being used to axially translate the trough carrier from the trestle.

First, FIG. 5A provides a side view of the pipe-handling machine 100 of FIG. 2, with the trestle 200 shown in an upper position in order to deliver a joint of pipe 50 onto the drilling rig floor 12. The joint of pipe 50 could be drill string, casing, production tubing, or any other type of jointed tubular. The rig floor height in this Figure is lower than the rig floor height of FIG. 3. A trough carrier transport mechanism 310A is being used to axially translate the trough carrier 300 from the trestle 200. Here, the trough carrier transport mechanism 310A simply employs a hydraulically operated cylinder 312A to extend the trough carrier 300 along the longitudinal plane of the trestle 200.

Figure 5B:
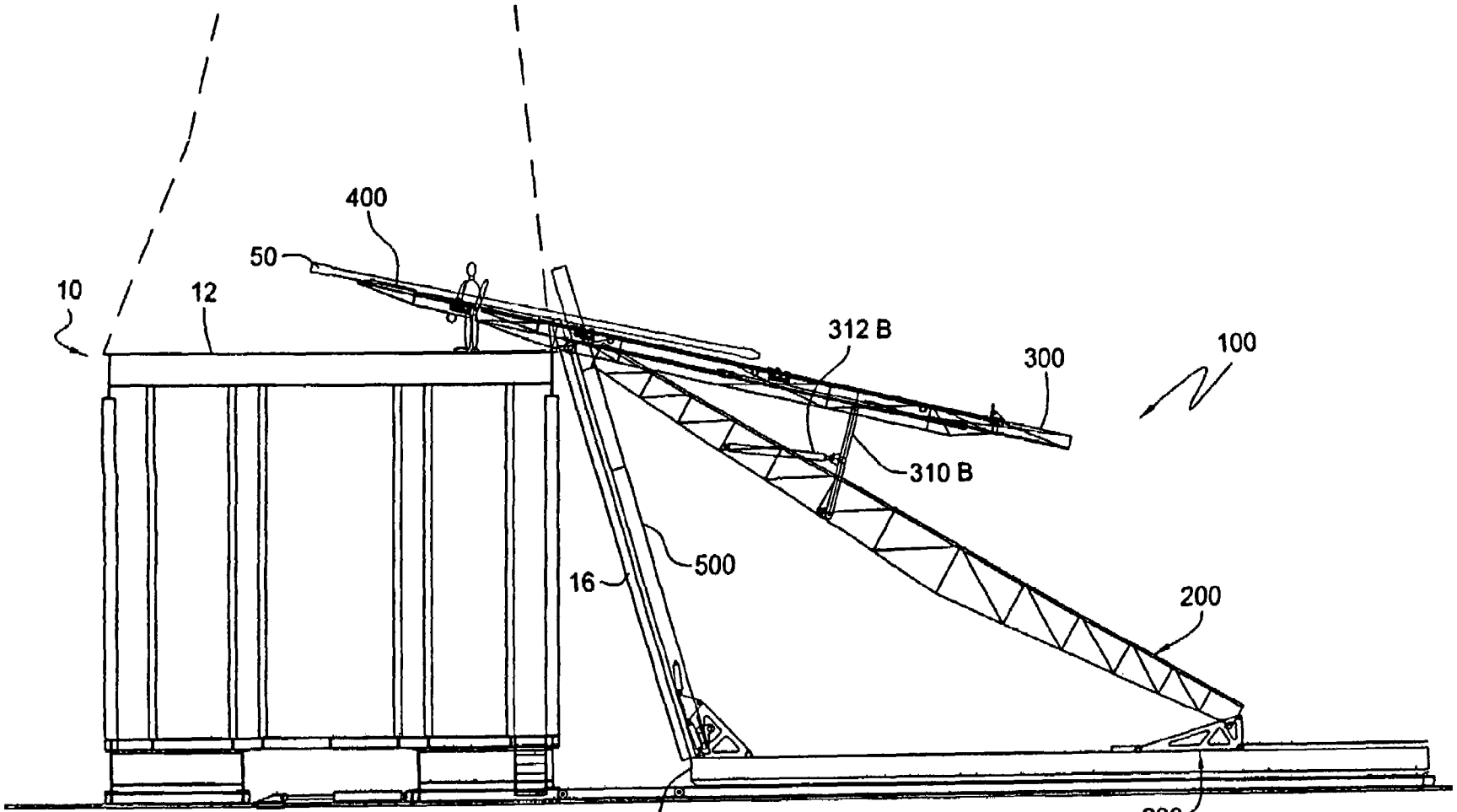
FIG. 5B is a side view of the pipe-handling machine of FIG. 2, with the trestle shown in an upper position in order to deliver a joint of pipe onto the drilling rig floor. The rig floor height in this Figure is higher than the rig floor height of FIG. 5A. A trough carrier transport mechanism is being used to raise the rear end of the trough carrier above the trestle, thereby reducing the angle of the pipe relative to the rig floor.

Next, FIG. 5B presents a side view of the pipe-handling machine 100, with the trestle 200 again shown in an upper position in order to deliver a joint of pipe 50 onto a drilling rig floor 12. The rig floor height in this Figure is higher than the rig floor height of FIG. 5A. Here, a trough carrier transport mechanism 310B is used to raise the trough carrier 300 from the trestle 200. The trough carrier transport mechanism 310B employs a hydraulically operated cylinder 312B to extend the rear portion of the trough carrier 300 directly upward relative to the trestle 200. The angle of approach for the pipe 50 towards the drilling rig floor 12 is thereby lessened.

Figure 5C:
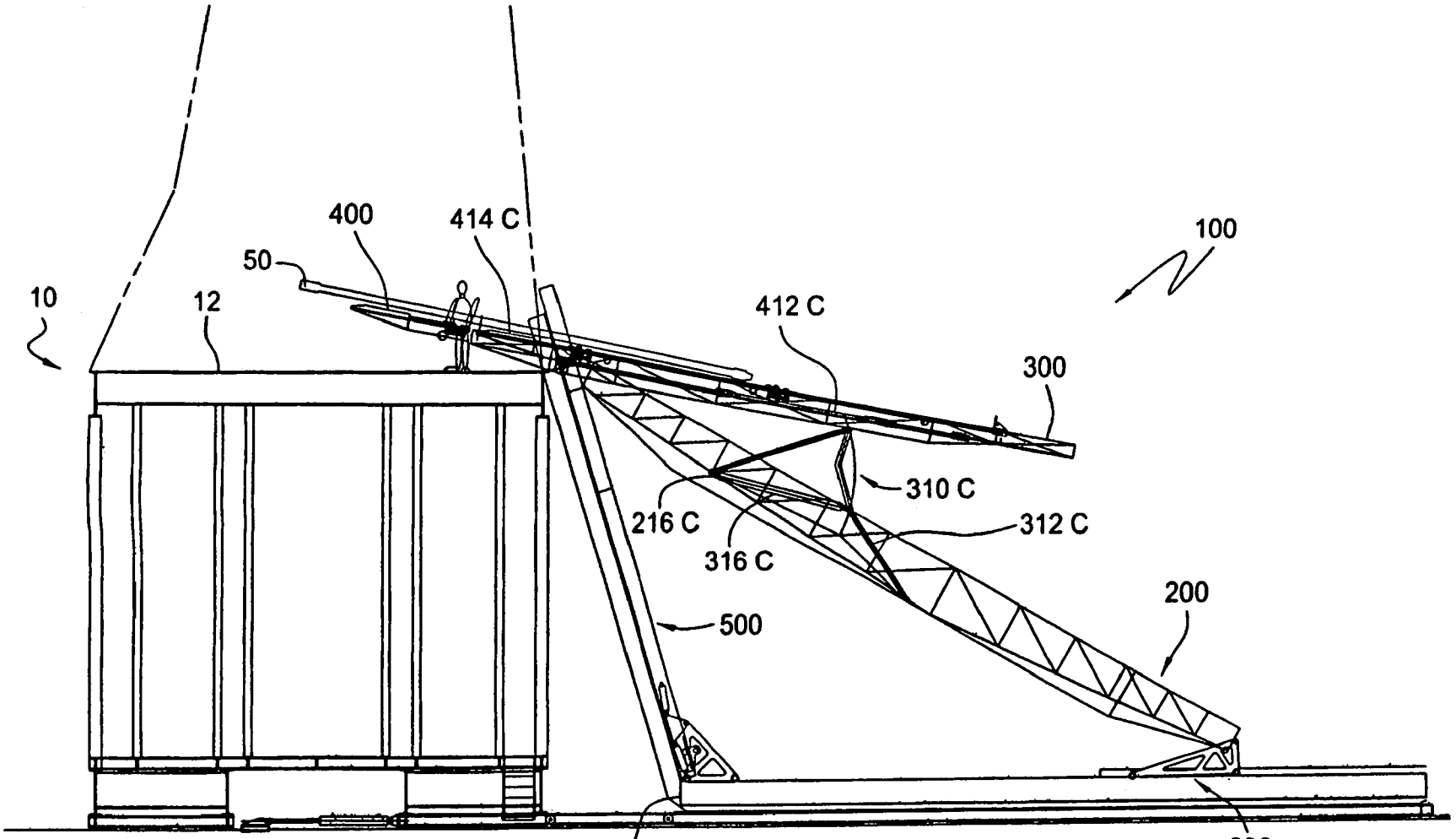
FIG. 5C presents a side view of a pipe-handling machine having an alternate embodiment for a trough carrier transport mechanism. In this arrangement, the trough carrier transport mechanism is being used to both raise and translate forward the trough carrier from the trestle.

FIG. 5C presents a side view of a pipe handling machine 100 having yet another alternate embodiment for a trough carrier transport mechanism 310C. In this arrangement, the trough carrier transport mechanism 310C is being used to both raise and translate forward the trough carrier 300 from the trestle 200. Here, the trough transport mechanism 310C employs a hydraulically operated cylinder 312C to extend the trough carrier 300 forward relative to the trestle 300. At the same time, the cylinder 312C is pivotally pinned to a fixed-length brace 316C that causes the trough carrier 300 to also extend upward. The brace 316C is preferably attached to the trough carrier 300 at the same pivot point as the telescoping cylinder 312C. The brace 316C has a lower end that will slidingly engage the trough carrier 300. In the retracted position, the brace 316C will be nearly parallel with the longitudinal axis of the trestle 200, and the trough carrier 300 will be parallel with the trestle 200. When the hydraulic cylinder 312C begins to extend, it first moves the trough carrier 300 and the brace 316C forward relative to the trestle 200. The forward end of the brace 316C will eventually hit a stop 216C, causing the brace 316C to rotate upward, pivoting the trough carrier 300 upward relative to the trestle 200. In this way, full extension of the trough carrier 300 may be achieved while also reducing the angle of approach for the nested pipe 50.

As noted, the pipe pick-up and laydown machine 100 also comprises a trough 400. The trough 400 defines an elongated frame configured to cradle a pipe section, such as a drill pipe 50 or other pipe employed in drilling a well. In one arrangement, the trough 400 is fabricated from a set of six elongated beams (shown at 408 in FIG. 2B and FIG. 12C) welded side-by-side to form an essentially concave upper receiving surface 416. The affixed beams 408 are seen in the cross-sectional view of FIG. 2B. The trough 400 is longitudinally movable relative to the trough carrier 300. A trough transport mechanism 410 is provided for selectively moving the trough 400 along the trough carrier 300, and then retracting the trough 400 back into the trough carrier 300. Preferably, the trough transport mechanism 410 also defines a hydraulically operated cylinder 412C (seen in FIG. 5C) having at least one telescoping section 414C. The hydraulically operated cylinder 412C is fastened to the trough carrier 300, and is oriented so that the telescoping section 414C extends outward towards the drilling rig 10. Thus, extension of the telescoping section 414C serves to extend the trough 400 partially out of the trough carrier 300 and towards the drilling rig 10. Of course, other means for sliding the trough 400 relative to the trough carrier may be employed.

At this point, it should be noted that there is significant advantage to employing both a trough carrier transport mechanism 310 and a trough transport mechanism 410. Those of ordinary skill in the art will appreciate that if pipe 50 were moved onto the rig floor 12 using only the trough 400 and trough transport mechanism 410, the extent of reach over the rig floor 12 would be more limited, e.g., approximately eight feet. However, when the pipe 50 is delivered with the additional support of the trough carrier 300 and the additional reach of the trough carrier transport mechanism 310, pipe 50 may be delivered an additional eight feet over the rig floor 12 for a net delivery of 16 feet. In addition, heavier pipe, such as 10 inch drill collars, may be delivered.

As can be seen in FIG. 3, as well as in each of FIGS. 5A, 5B and 5C, the front end 202 of the trestle 200 is carried upwards toward the rig floor 12 along the inclined ramp 500. The connection between the front end 502 of the trestle 200 and the ramp 500 is by means of a carriage 550. The carriage 550 is designed to transport the forward end 202 of the trestle 200 between the upper 504 and lower 502 ends of the ramp 500. In one arrangement, the carriage 550 comprises a U-shaped channel body that has rollers (not shown) on opposite ends. Front and side views of the carriage 550 can be seen in FIGS. 6A and 6B, respectively.

It is desirable that the pivoting connection between the trestle 200 and the carriage 550 be removable. In this respect, it may be necessary to lift the entire pipe-handling machine 100 onto a catwalk on an offshore platform (not shown). Offshore rigs have a crane-lifting capacity, such as 20,000 pounds. However, the combined trestle 200 (and nested trough carrier 300 and trough 400) and ramp 500 will, in one embodiment, weigh approximately 28,000 pounds. Out of this total weight, the ramp 500 and carriage 550 and accompanying parts, e.g., chains 517, will account for about 10,000 pounds. Releasable connecting pins 536 (shown in FIGS. 4A and 7) are used for the pivoting connection between the trestle 200 and the carriage 550.

Figure 7:
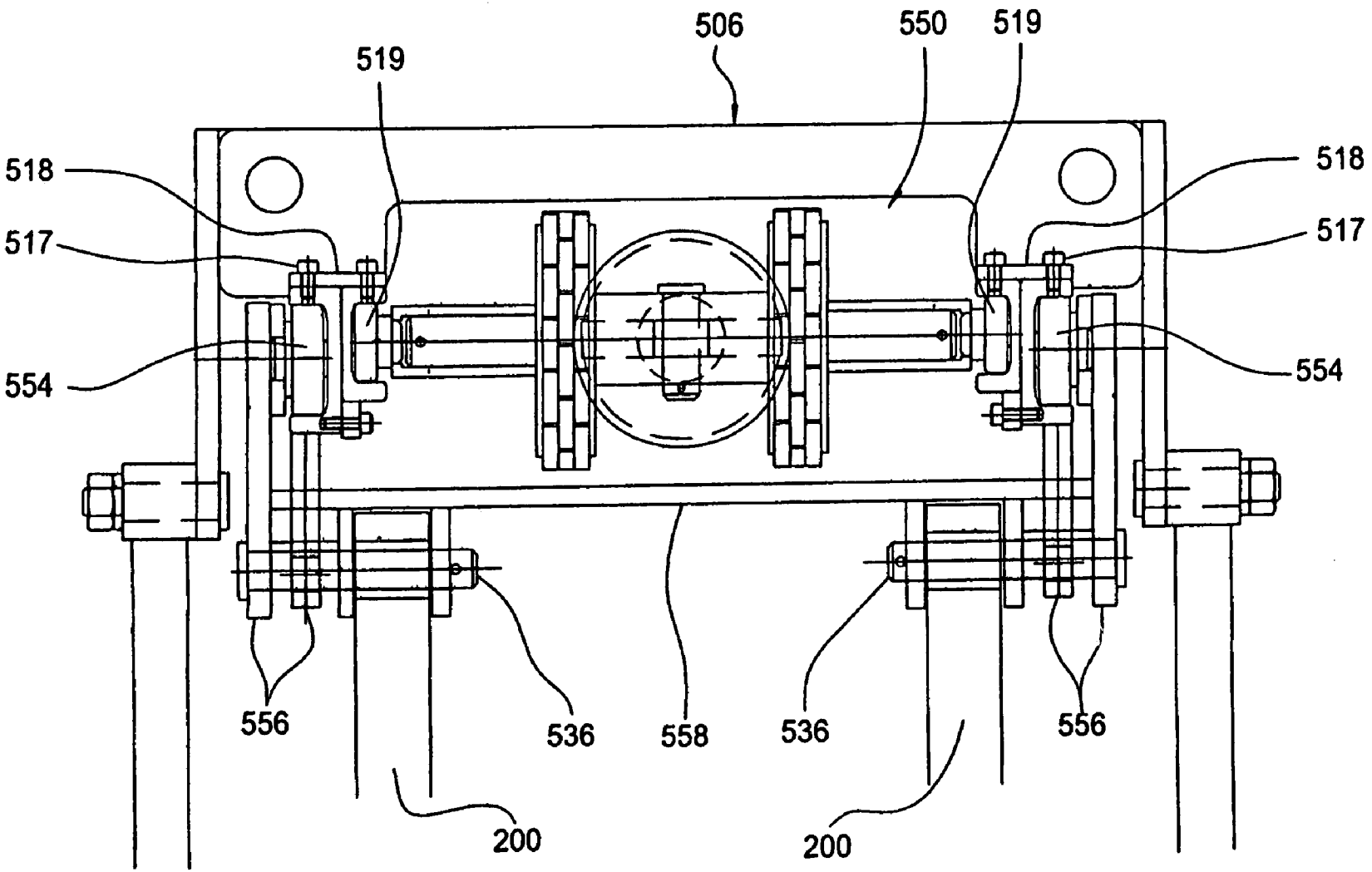

FIG. 7 demonstrates a top view of the frame of FIG. 6A. Visible in this view is the top of the frame 506, including portions of a sheave 518 and the carriage 550. The rollers of the carriage 550 are received in oppositely-facing U-shaped channel tracks 554 that are secured in spaced relation within the carriage 550 by suitable transverse members, such as plate 558. The carriage 550 has ears 556 which receive pins 536 for pivotally mounting the trestle 200 to the carriage 550. The carriage 550 is connected to a pair of chains 517 rove over a pair of spaced sheaves 518 mounted on the end of telescoping section 514 of the trestle transport mechanism 570. The pair of sheaves 518 is positioned within the U-shaped channel that defines the carriage 550. One end of the chains 517 is secured to the frame 500 at an anchor point on the side proximate to the drilling rig 10. The other end of the chains 517 is secured to the carriage 550 by a suitable pin or other securing means (not shown). The result is that for every foot of lift accomplished by extension of the trestle transport mechanism 570, the carriage 550 is lifted two feet.

Figure 8A:
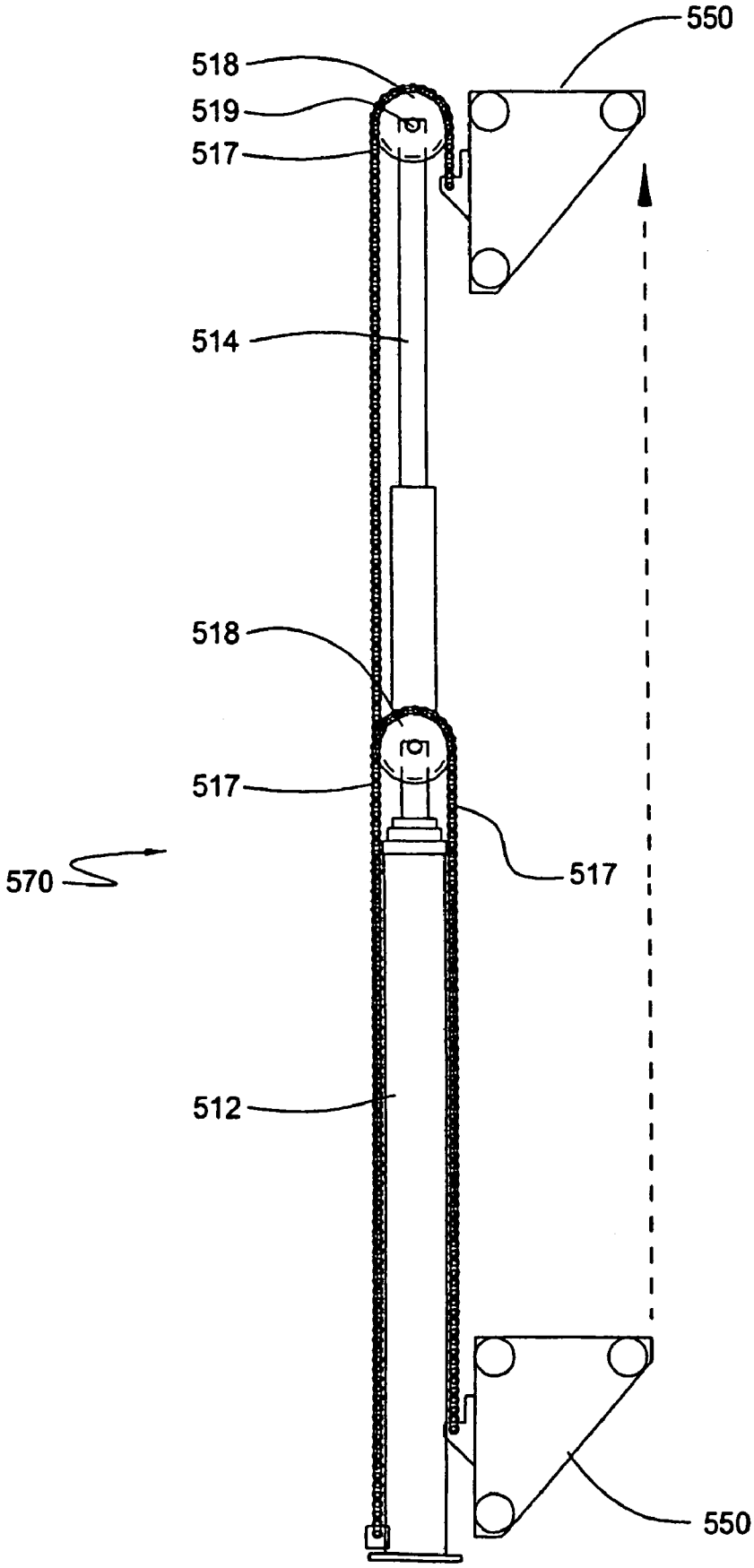
FIG. 8A is a side view of a trestle transport mechanism as might be incorporated within the frame of FIG. 6A. In this arrangement, the trestle transport mechanism employs telescoping sections that are hydraulically extended. A sheave is incorporated into the trestle transport mechanism. The sheave is shown both in its start position and in its fully elevated position. A dashed line shows the extension of the sheave from its starting position to its elevated position.

The two-to-one ratio of extension-to-lift provided in the present ramp 550 means that the anchor point for the chain 517 must be at approximately the halfway point up the frame 506. Thus, the anchor point is adjustable. The adjustable nature of the ramp 500 and the anchor point is demonstrated in FIGS. 8A-8C. FIG. 8A presents a schematic view of the trestle transport mechanism 570. The sheave 518 is shown both in a start position and in a fully elevated position. The carriage 550 is translated by one or more chains 517. The chains 517, in turn, are rove by the sheaves 518 at the top of the last telescoping section 514. As the telescoping section 514 is extended from the hydraulic cylinder 512, the sheave 518 is raised. This has the effect of expediting the lifting of the carriage 550 and attached trestle 200.

It can also be seen in FIG. 7 that a second pair of rollers 519 is provided inside the carriage rollers 554. More specifically, rollers 519 serve to guide the telescoping cylinders 514 of the trestle transport mechanism 570 as the cylinders 514 are raised along the ramp 500.

Figure 9A:
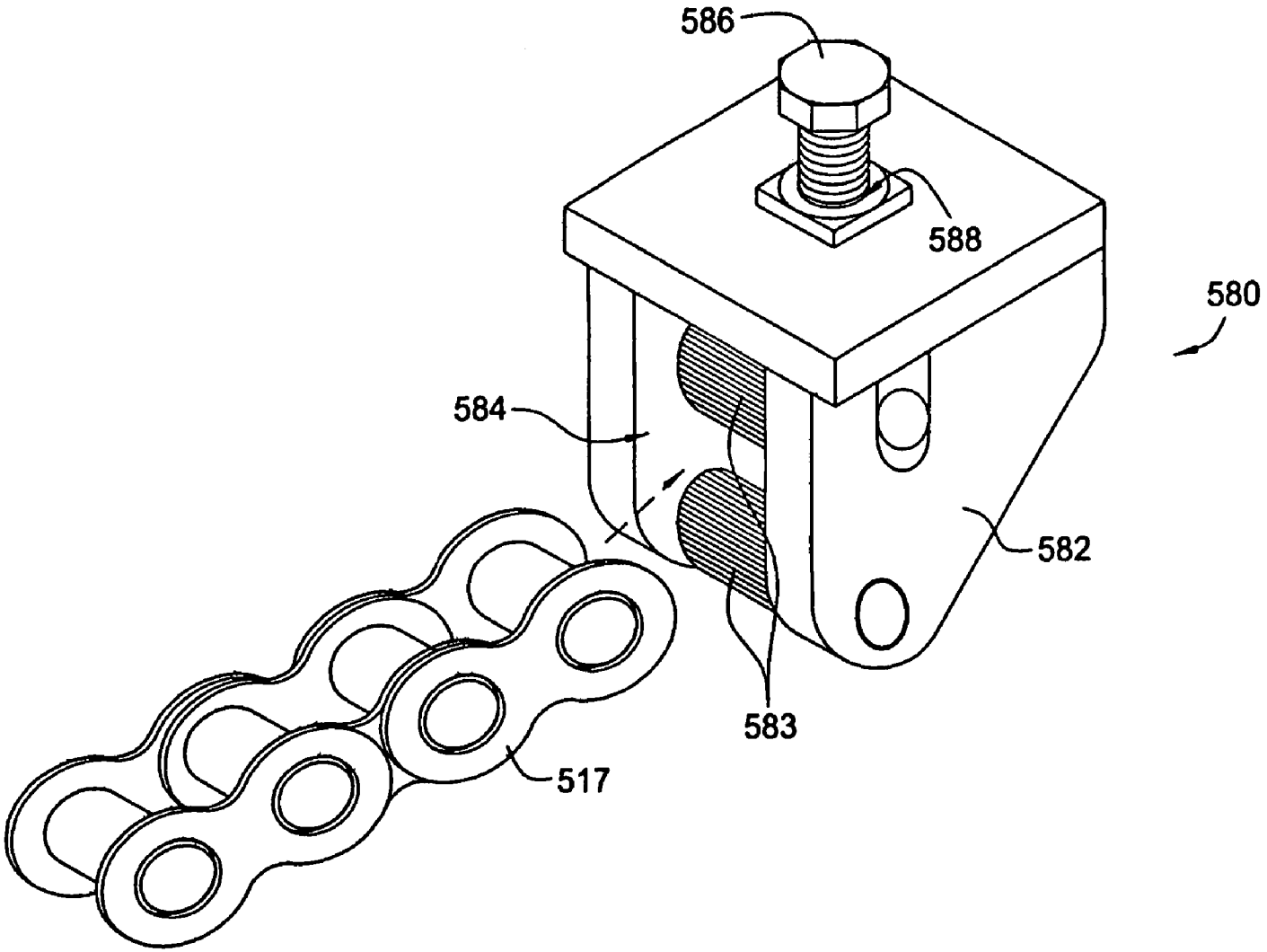
FIG. 9A presents a novel connector as may be used to connect the chains to the carriage. The connector has not yet received the chain.

FIG. 9A presents a novel connector 580 as is preferably used to connect one of the chains 517 to the carriage 550. The connector 580 generally comprises a bracket 582 having an opening 584 for receiving the chain 517. The bracket 580 shown in FIG. 9A is generally U-shaped. A fastening bolt 586 is movably connected to the bracket 582. The bolt 586 has a first end external to the bracket 582, and a second end (not seen) within the opening 584 for selectively engaging and releasing the chain 517. Preferably, the bolt 586 is threadedly received within a mating threaded opening 588 in the bracket 580. Movement of the fastening bolt 586 is accomplished by turning the bolt 586.

The novel connector 580 allows the point of connection between the carriage 550 and the chain 517 to be quickly adjusted, depending upon the number of extensions to be added to the ramp frame. Stated another way, the anchor point for the chain 517 is more easily adjustable. Any excess chain length is gathered within the frame 506, or may be allowed to simply dangle.

In FIG. 9A, the chain 517 has not yet been inserted into the connector 580. It can be seen that in the arrangement of FIG. 9A, the chain 517 is received through a pair of grooved bars 583. The position of the upper bar is adjustable in response to movement of the bolt 588.

Figure 9B:
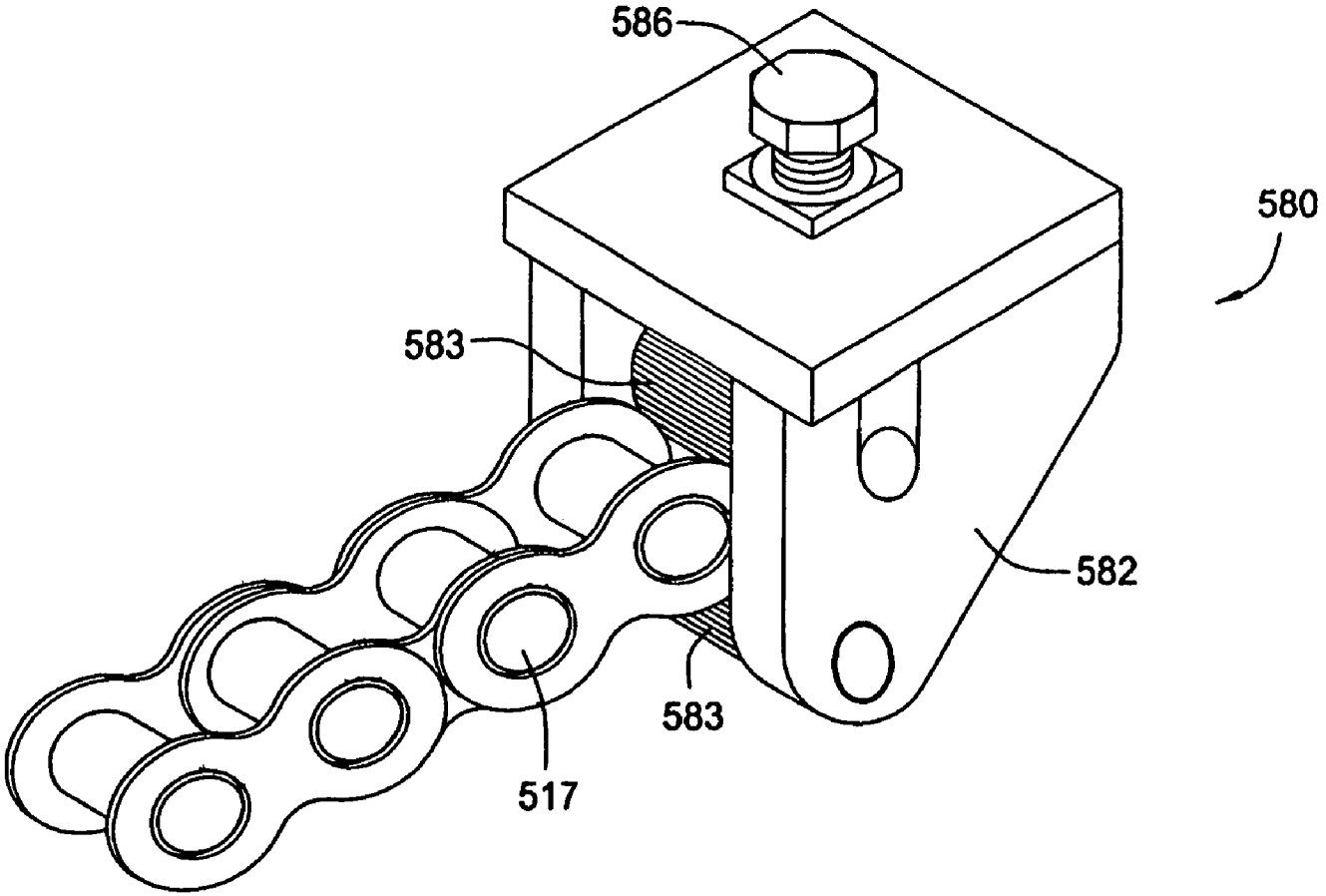
FIG. 9B presents the chain connector of FIG. 9A. In this view, the connector has received the chain. A bolt has been driven into position for securing the chain.

FIG. 9B presents a perspective view of the chain connector 580 of FIG. 9A, with the chain 517 being received within the bracket 582. The bolt 586 has been tightened into the bracket 582. Movement of the bolt has caused the upper bar 583 to clamp the chain 517.

Figure 8B:
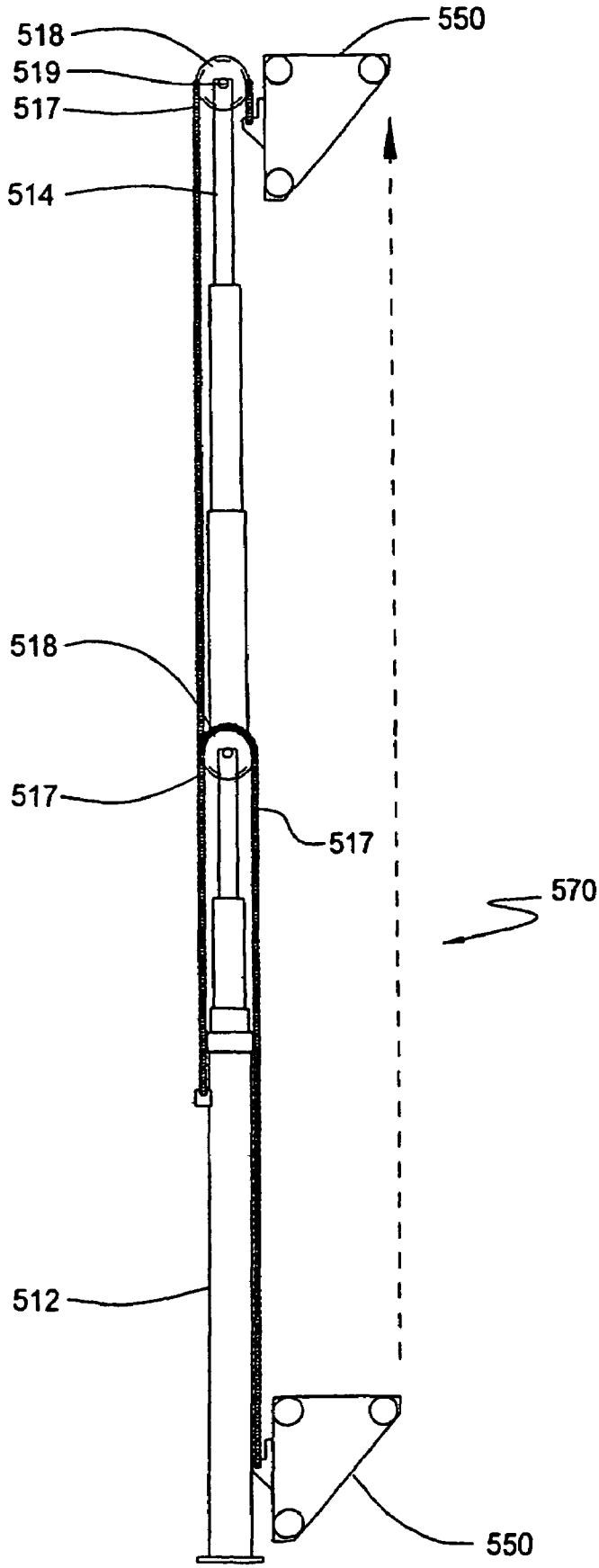
FIG. 8B is a schematic view of the trestle transport mechanism of FIG. 8A, shown adjusted for yet a higher start position and a higher fully elevated position than in FIG. 8A. Additional telescoping sections are provided for the trestle transport mechanism.
Figure 8C:
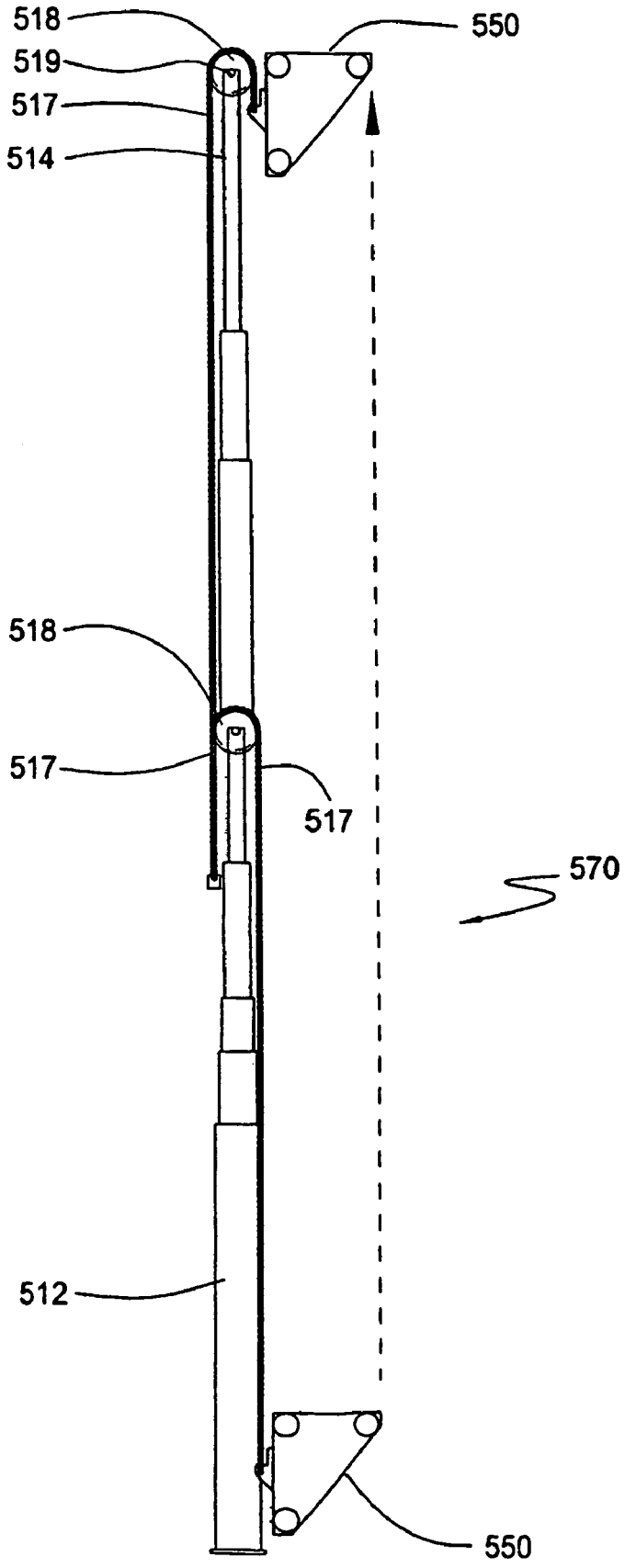
FIG. 8C is a schematic view of the trestle transport mechanism of FIG. 8A, shown adjusted for yet a higher start position and a higher fully elevated position than the trestle transport mechanism of FIG. 8B.

FIG. 8B provides another schematic view of the trestle transport mechanism 570. Here, the anchor point is adjusted for a higher start position and a higher fully elevated position than in FIG. 8A. FIG. 8C provides an additional schematic view of the trestle transport mechanism 570, shown adjusted for a still higher start position and still higher fully elevated position.

In operation, the hydraulic cylinder 522 for the ramp 500 is actuated so as to retract the corresponding telescoping arm 524. This causes the ramp 500 to be raised from its nested position within or immediately above the trestle 200. The ramp 500 is preferably positioned against an already-existing V-Door ramp for support. For safety reasons, the top 504 of the frame 506 should be tied to the rig floor 12 at this point before any joints of pipe 50 are picked up.

The hydraulic cylinder 512 of the ramp 500 is next actuated so as to extend the telescoping arms 514 from hydraulic cylinder 512. This serves to lift the carriage 550 upward along the ramp 500. As the telescoping sections 514 are extended, the carriage 550 travels up the frame 506 of the ramp 500. The carriage 550 has a starting point at the level of the catwalk 190. Because of the 2:1 ratio of travel time, the carriage 550 is able to "catch up" to the height of the extended telescoping sections 514 at the height of the rig floor 12.

As noted, the forward portion 202 of the trestle 200 is pivotally pinned to the carriage 550. The carriage 550 has ears 556 which receive pins 536 for pivotally mounting the trestle 200 to the carriage 550. Rollers (not shown) are positioned within the frame 500 on either side of the trestle 200. The rollers ride within the guide system for the carriage 550 defined by the frame 506. As the carriage 550 is raised along the ramp frame 506 the rollers travel upward along the frame 500 inside oppositely-facing channels 554. The forward portion 202 of the trestle 200 is thus raised to a level at or above the rig floor 12.

An additional optional feature of the trestle 200 is a pair of articulating legs 230. The articulating legs 230 are pinned to the rear portion 204 by pins 209. Attachment of one of the articulating legs 230 to the trestle 200 by pin 209 is seen in FIG. 4A. The articulating leg 230 is slightly shorter than the rear portion 204 of the trestle 200. As shown in FIGS. 2 and 4A, the articulating leg 230 in one embodiment defines a triangular truss type member having an upper hypotenuse leg 235 and a slightly shorter base leg 234. A third leg 236 connecting the base 234 and hypotenuse 235 legs is a much shorter leg. The shorter leg 236 connects the ends of the legs 234, 235 to form the triangular articulated leg 230.

Each upper leg 234 is pinned to the back portion of the trestle 200 by pins 209. The base 234 and hypotenuse 235 legs, in turn, each meet at a pin which carries a roller 246. The rollers 246 move in a track 248 (seen best in FIG. 4) along the base 240.

Figure 4:
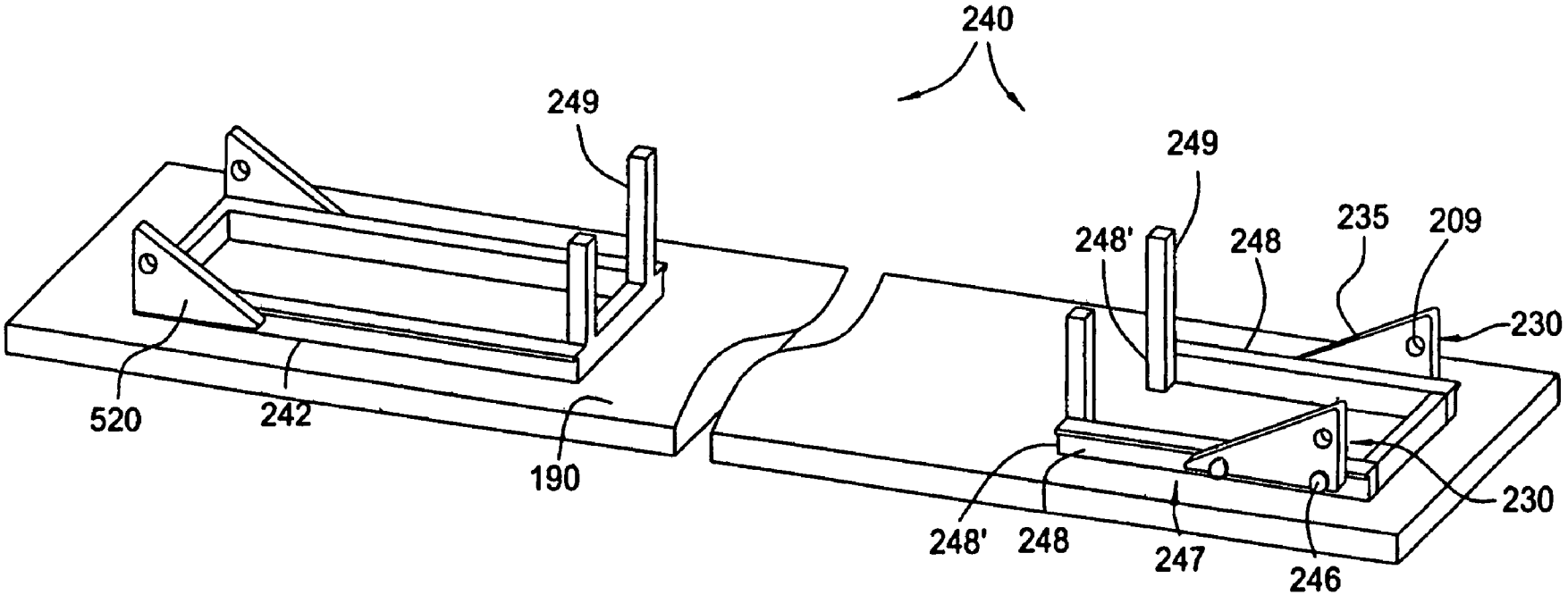
Figure 4A:
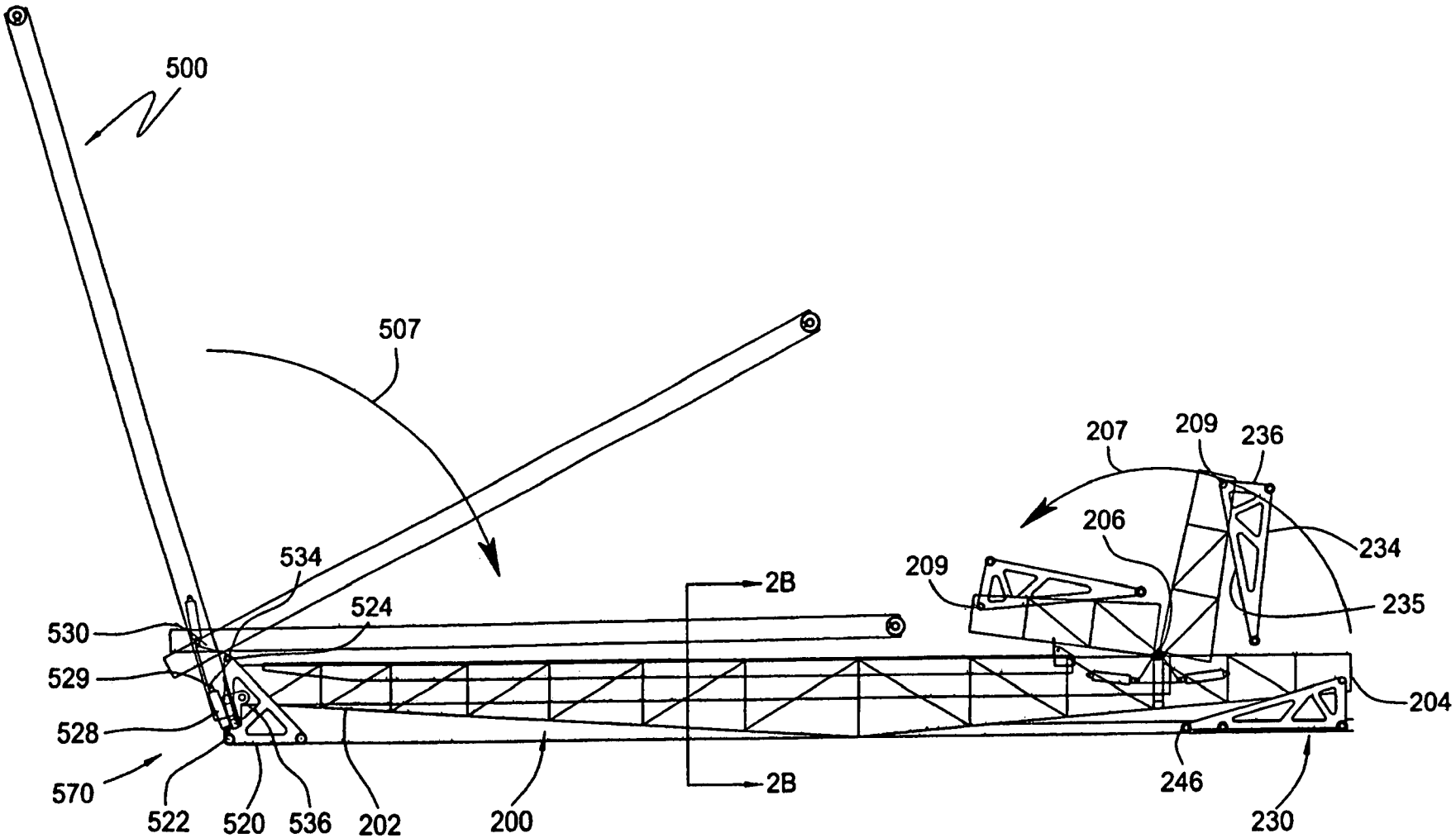
FIG. 4A presents yet another side view of the pipe-handling machine of FIGS. 1 and 2. In this view, the trestle is back in its lower position. A rear portion of the trestle is being folded over in order to shorten the length of the trestle for transportation. The inclined ramp is also being folded over the trestle. A ramp rotation mechanism is used to rotate the ramp.
Figure 4B:
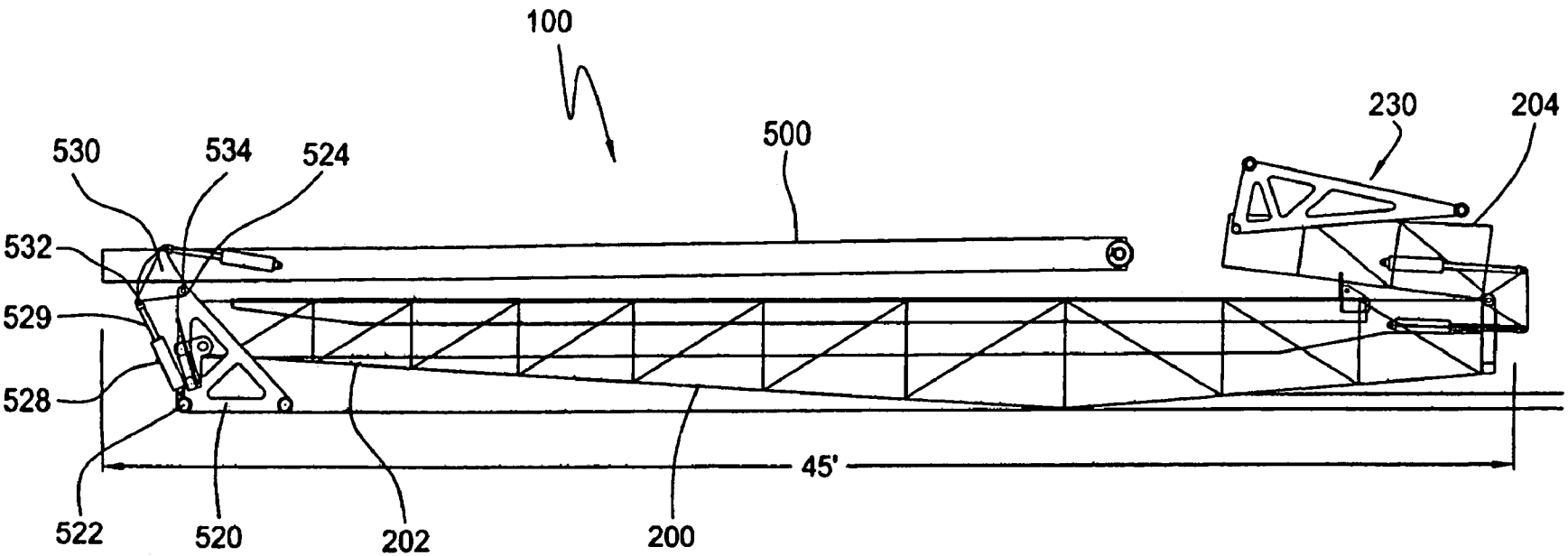
FIG. 4B shows a side view of the pipe-handling machine of FIG. 4A. In this view, the rear portion of the trestle has been folded over the trestle, and the inclined ramp has also been folded over the trestle. The pipe-handling machine is now ready for transport to a new rig site.

FIG. 4 presents a perspective view of a base structure 240 as might be used to support the trestle 200, and to pivotally connect to the ramp 500. A front portion 242 connects to the ramp 500, while a rear portion 244 connects to the trestle 200. As shown in FIG. 4, the base 240 in one arrangement defines two parallel tracks 248. The track 248 serves as a guide system for the trestle 200 as it is moved. The track 248 includes a pair of stop members 248' (shown in FIGS. 3 and 4) at the forward end of the rear portion 204 of the trestle 200. The stop members 248' limit the forward movement of the rollers 246 on the articulating legs 230. When the front end 202 of the trestle 200 is raised along the inclined ramp 500 into the raised position shown in FIG. 3, the back end 204 of the trestle 200 is first moved forward until the rollers 246 engage the stops 248'. From there, the articulating legs 230 pivot so as to cause the rear portion 204 of the trestle 200 to be raised. With this arrangement, no independent vertical assist is required to lift the back end 204 of the trestle 200. Raising the back end 204 of the trestle 200, in turn, reduces the approach angle of the pipe joints 50 as they are delivered to or removed from the rig floor 12.

Various other arrangements for pivotally lifting the rear portion 204 of the trestle 200 may be provided. Exemplary arrangements are provided in U.S. Pat. No. 4,403,898 issued to Thompson on Sep. 13, 1983. The '898 Thompson patent is incorporated herein in its entirety, by reference.

Figure 10A:
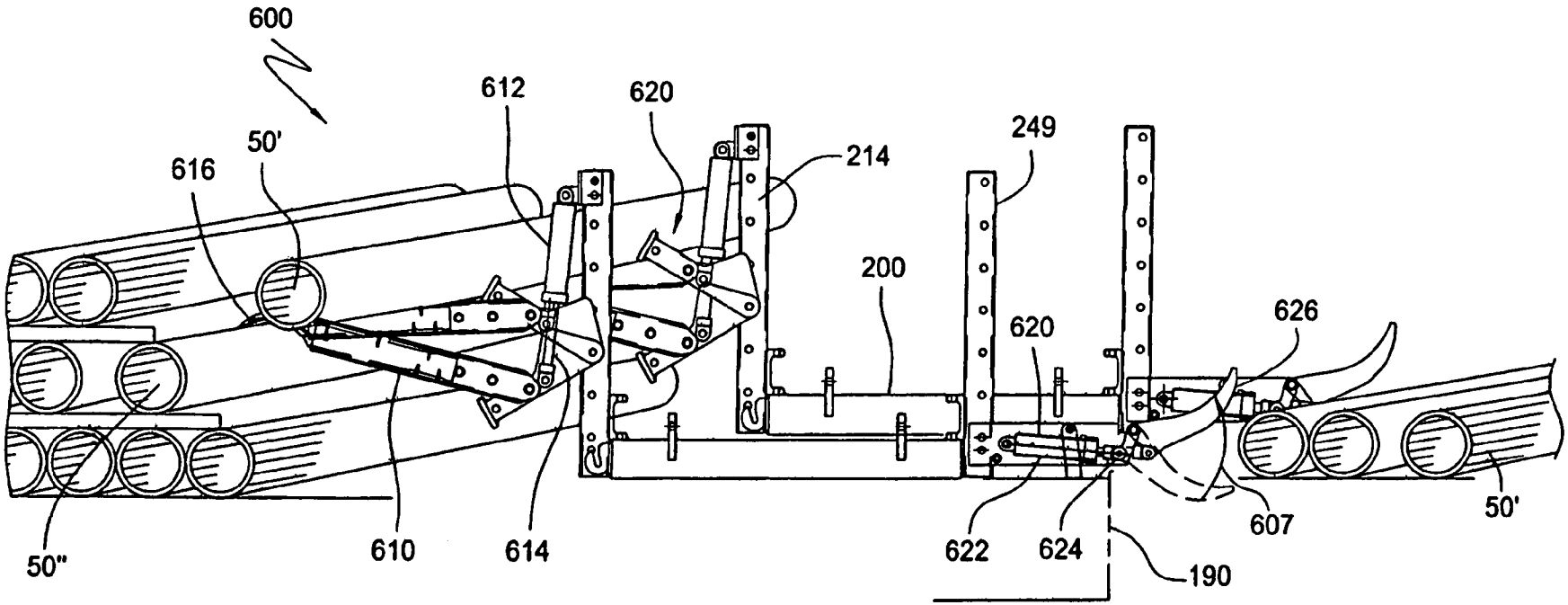
FIG. 10A provides a perspective view of a base frame for the trestle for the pipe pickup and laydown machine of the present invention, in one arrangement. The trestle, trough carrier and trough have been removed for purpose of illustration. In this embodiment, two arms are seen—a lifting arm and a stabilizing arm. The arms are affixed to opposite sides of the base frame.

It is desirable to provide a means for loading pipe 50 from the pipe racks into the trough 400 of the machine 100, and vice versa. Accordingly, a loading apparatus 600 is optionally provided. The loading apparatus 600, in one arrangement, is shown in FIG. 10A. FIG. 10A provides a perspective view of a trestle 200 for the pipe pickup and laydown machine 100 of the present invention, in one arrangement. The trough carrier 300 and trough 400 have been removed for purpose of illustration. In this embodiment, two arm are seen—a lifting arm 620; and a stabilizing arm 610. The arms 620, 610 are affixed to opposite sides of the trestle 200. More specifically, the arms 620, 610 are affixed vertical frame members 249 from the trestle support frame 240.

First, the loading apparatus 600 employs at least one lifting arm 620. The lifting arm 620 shown in FIG. 10A is disposed on a side of the trestle frame 240, i.e., affixed to vertical structural support member 249. In this way, the arm 620 may readily access pipe 50' on the pipe racks adjacent the catwalk 190. Optionally, additional lifting arms 620 may be disposed on each side of the trestle 200. In this manner, a lifting arm 620 can receive pipe on one side of the trestle 200 during the pick-up phase, and deliver pipe to the opposite side of the trestle 200 during the laydown phase.

The lifting arm 620 is preferably hydraulically operated. First, a cylinder may be actuated to translate the arm 620 up and down along the sides of the trestle 200. The lifting arm 620 typically lifts transverse to the trestle 200 (as shown), or may be configured to rotate along the longitudinal plane of the trestle 200 (arrangement not shown). The lifting arm 620 also includes, in one arrangement, a hydraulic cylinder 622 that receives a telescoping section 624. This allows the arm 620 to be moved into lifting position.

An upwardly facing concave hand 626 is disposed at the distal end of the telescoping section 624. The concave hand 626 is positioned under the first pipe 50' for lifting. Using the cylinder 622 and telescoping section 624 for the lifting arm 620, the hand 626 may be selectively angled inwards toward the trough 400. The lifting hand 626 may also be lowered to a position lower than the base of the trestle 200. The lifting arm 620 is simultaneously raised to a position so that the pipe 50' rolls off the hand 626 and into the trough 400. In FIG. 10A, rotational movement of the lifting hand is shown by arrow 607.

The loading apparatus 600 optionally further comprises one or more stabilizing arms 610. In the arrangement shown in FIG. 10A, a single stabilizing arm is 610 likewise disposed on a side of the trestle frame 240 to access pipe 50" on the pipe racks.

Figure 10B:
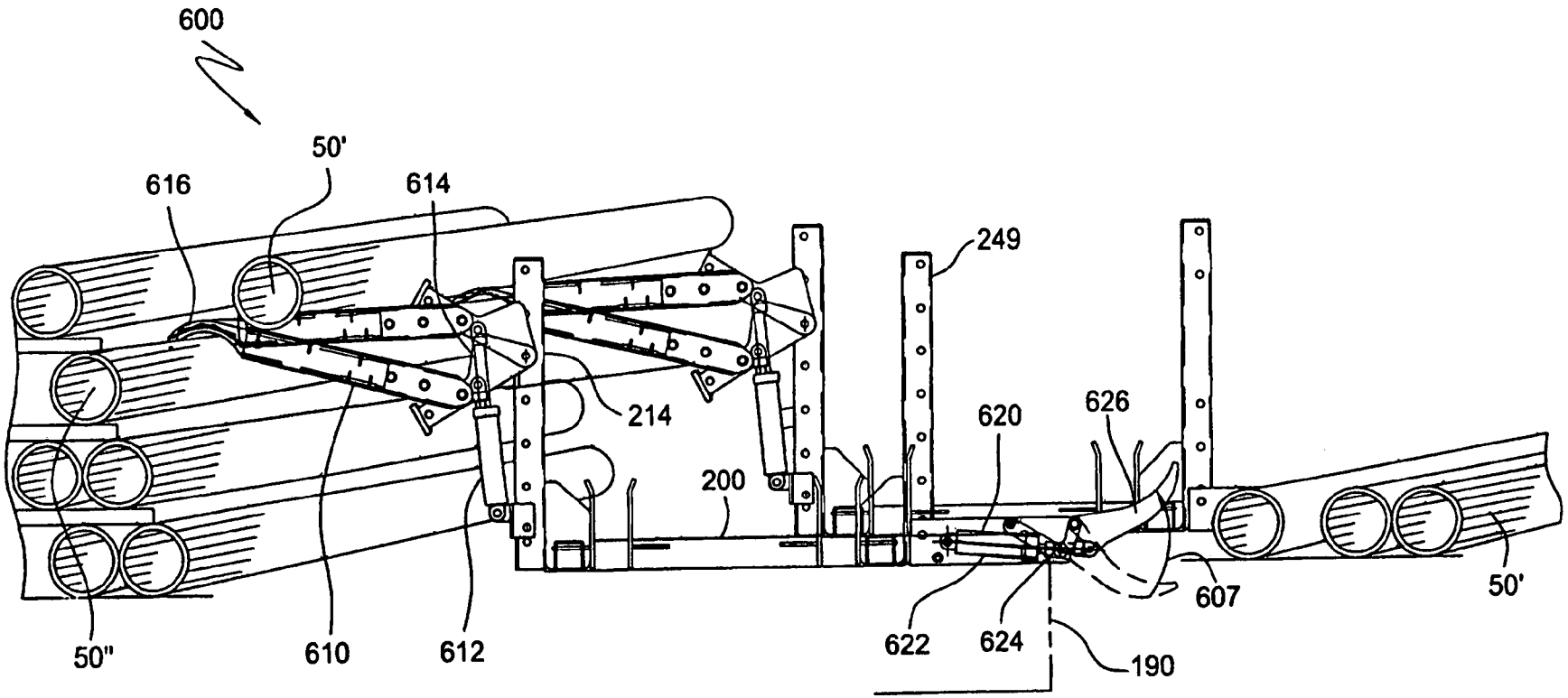
FIG. 10B presents an alternate arrangement of the trestle base frame of FIG. 9A. In this view, a stabilizing arm is again shown extending from one side of the frame. A lifting arm is also shown on the opposite side of the frame to assist in loading pipe into the trough.

The stabilizing arm 610 in one arrangement includes a hydraulic cylinder 612 for receiving a telescoping section 614. The fixed end of the cylinder 612 may be attached proximate the top of the support member 249 (as shown in FIG. 10A), or proximate the bottom of the support member 249 (as shown in FIG. 10B). A downward facing concave hand 616 is disposed at the distal end of the telescoping section 614. The concave hand 616 is positioned over a second pipe 50" on a pipe rack before a first pipe 50' is lifted. This provides the stabilizing function.

It should be noted that the concave hand 616 of the stabilizing arm 620 may be turned over and used as a lifting arm. Thus, in one arrangement, it is not necessary to employ both stabilizing arm 610 and lifting arm 620.

The loading apparatus 600 also employs a pair of pipe loading arms. For purposes of clarity, the loader arms are not shown in FIG. 10A or 10B, though it is understood that they are present. However, the loader arms are seen at 630 in FIGS. 2 and 4C(1)-(3). Each of the pipe loading arms 630 includes a rotating arm 632 that rotates along the longitudinal axis of the trestle 200. The arms 630 also each include a hand 636 that extends transverse to the respective rotating arms 632 in order to engage pipe 50'. Rotation of the rotating arms 632 is accomplished by selectively actuating a hydraulic cylinder and telescoping section (not shown) within the trestle 200. Actuation of the pipe loading arms 630 allows the arms to catch pipe 50' within the lifting arm 620, raise the pipe 50' upwards to the top of the trestle 200, and drop the pipe 50' into the trough 400.

The loader arms 632 begin in the down position when bringing pipe 50 over to the side of the machine 100. The arms 632 then rotate upward and carry the pipe 50 to the top of the trestle frame 200 where the pipe 50 rolls off the loader hand 636 and into the trough 400. The loader arms 632 remain in a raised position as the trestle 200 is elevated by the carriage 550 throughout the raise and lower cycles.

An additional optional feature provided for the machine 100 is a means for causing pipe 50 within the trough 400 to be expelled. When laying down pipe 50, the trestle 200 is lowered to a horizontal position. The pipe 50 contained within the machine 100 is then rolled out of the trough support members 408 and onto the lifting hands 626 as discussed above. One arrangement for ejecting pipe 50 from a trough is described in col. 4 of the '898 Thompson patent, and shown in FIG. 3 of that patent. However, for the present machine 100, FIGS. 11-12C illustrate a preferred mechanism for lifting pipe 50 out of the trough receiving surface 416 while it is in the horizontal position so as to cause the pipe 50 to roll onto a pipe rack.

Figure 11:
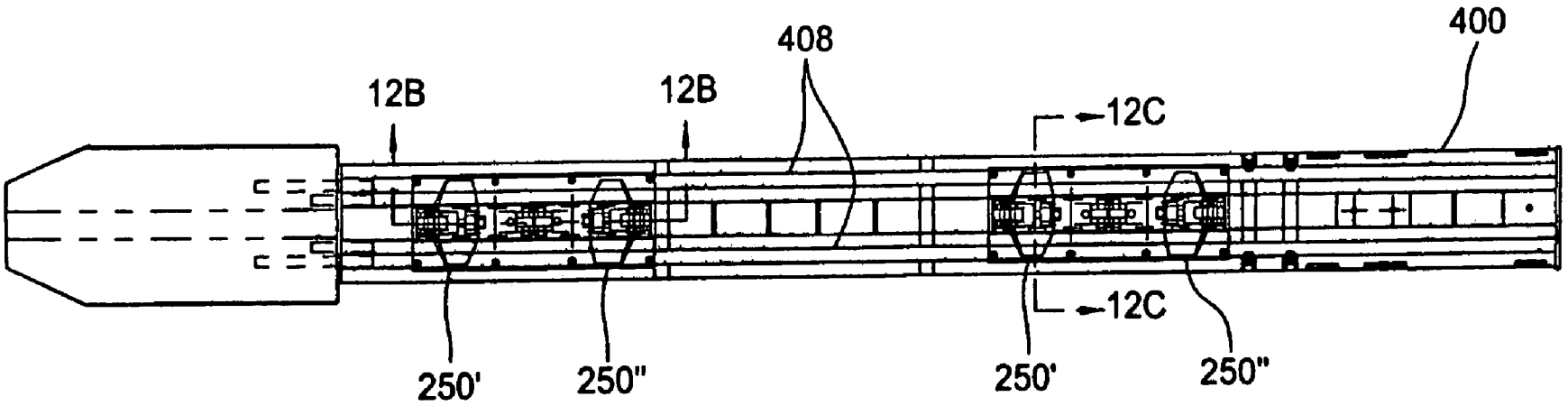

Referring now to FIG. 11, FIG. 11 presents a top view of the trough of FIG. 2A. Visible in this view are two pairs of lifting plates 250', 250". One pair of lifting plates 250' is in a retracted position, while the other pair 250" is in an extended position. The preferred pipe transfer mechanism 250 employs these pairs of lifting plates 250', 250" for ejecting pipe (not shown in FIG. 11) from the trough 400.

Figure 12A:
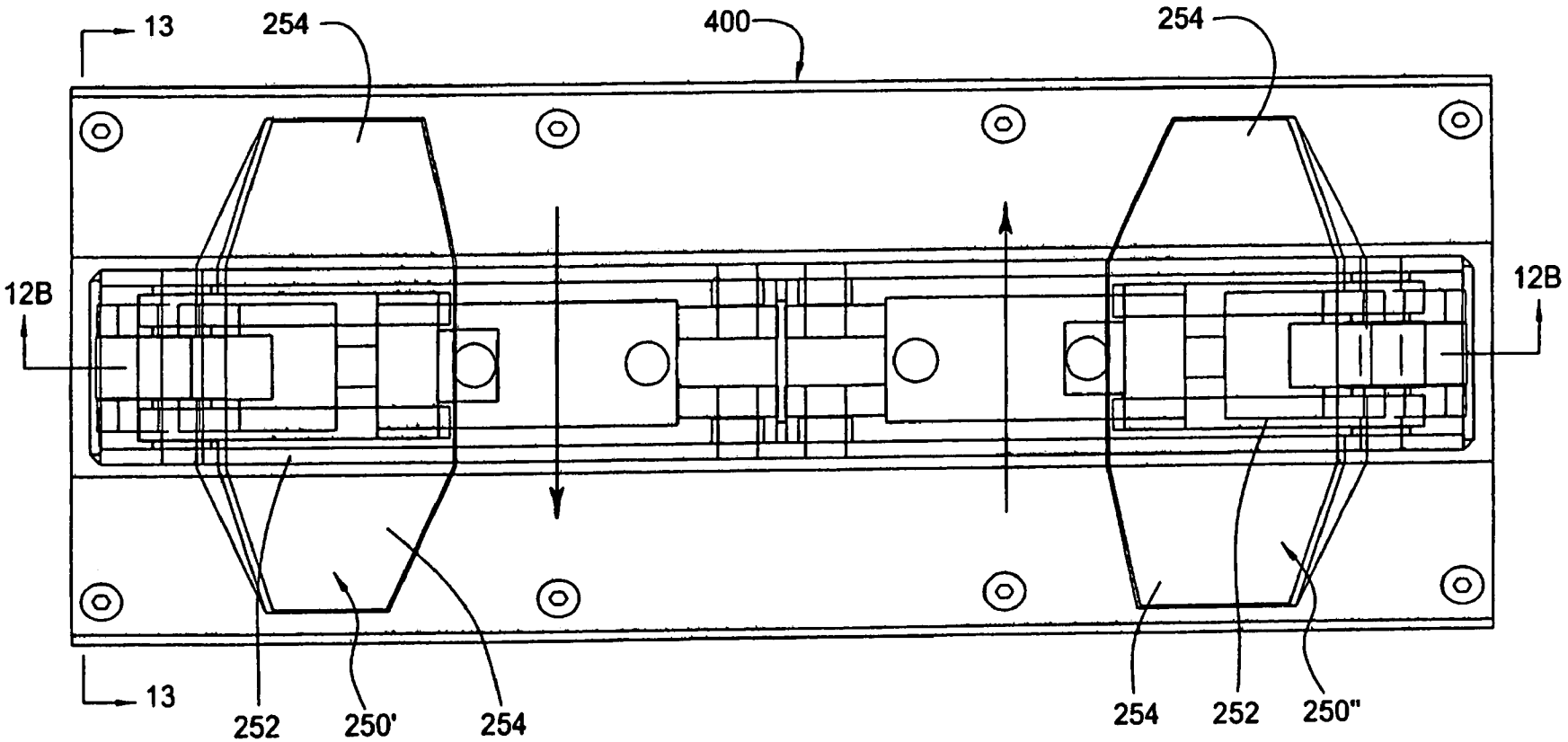
FIG. 12A provides an enlarged view of two lifting plates. Each lifting plate is mounted within the concave surface of the trough. The plates are used for urging a tubular from within the trough out of the trough. One plate urges the tubular to move to one side of the trough, while the other plate is actuated to move the tubular to the other side, depending on which side of the trough the pipe rack is positioned.

FIG. 12A provides an enlarged view of a lifting plate 250' and a second lifting plate 250". Each lifting plate 250', 250" is mounted within the concave surface of the trough 400. The lifting plates 250', 250" each define a central portion 252, and left and right opposing wings 254 extending away from the central portion 252. Wings 254 incline upward from the central portion 252 so that they are flush with the inclined sides of the trough 400. While in the retracted position, the central potion 252 is flush with the lower central portion of the trough 400. In the extended position, the wings 254 extend above the top plane of the trough 400.

Figure 12B:
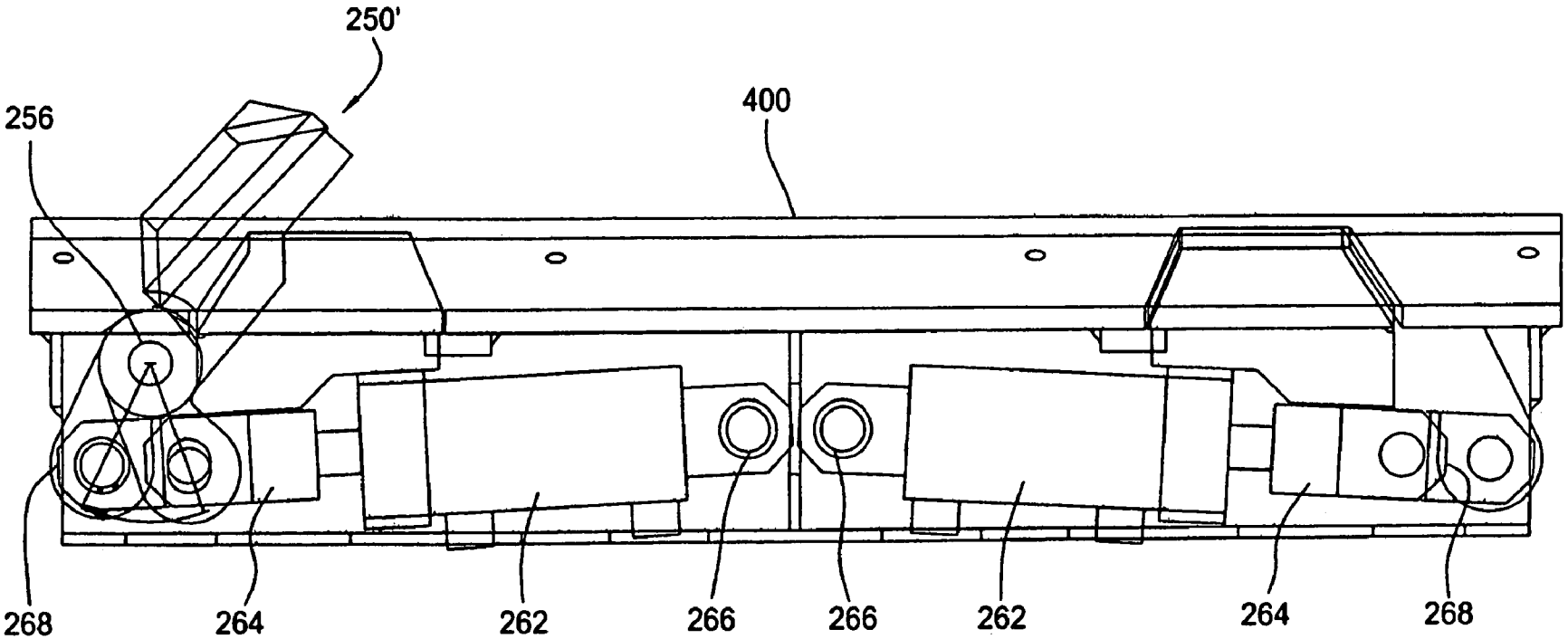
FIG. 12B shows the lifting plates of FIG. 12A in a side, cross-sectional view. The view is taken across line 12B-12B of FIG. 11. In this view, one of the plates has been actuated. It is understood that both plates will not be actuated simultaneously, since the plates are used to urge a pipe towards opposite respective sides of the trough.
Figure 12C:
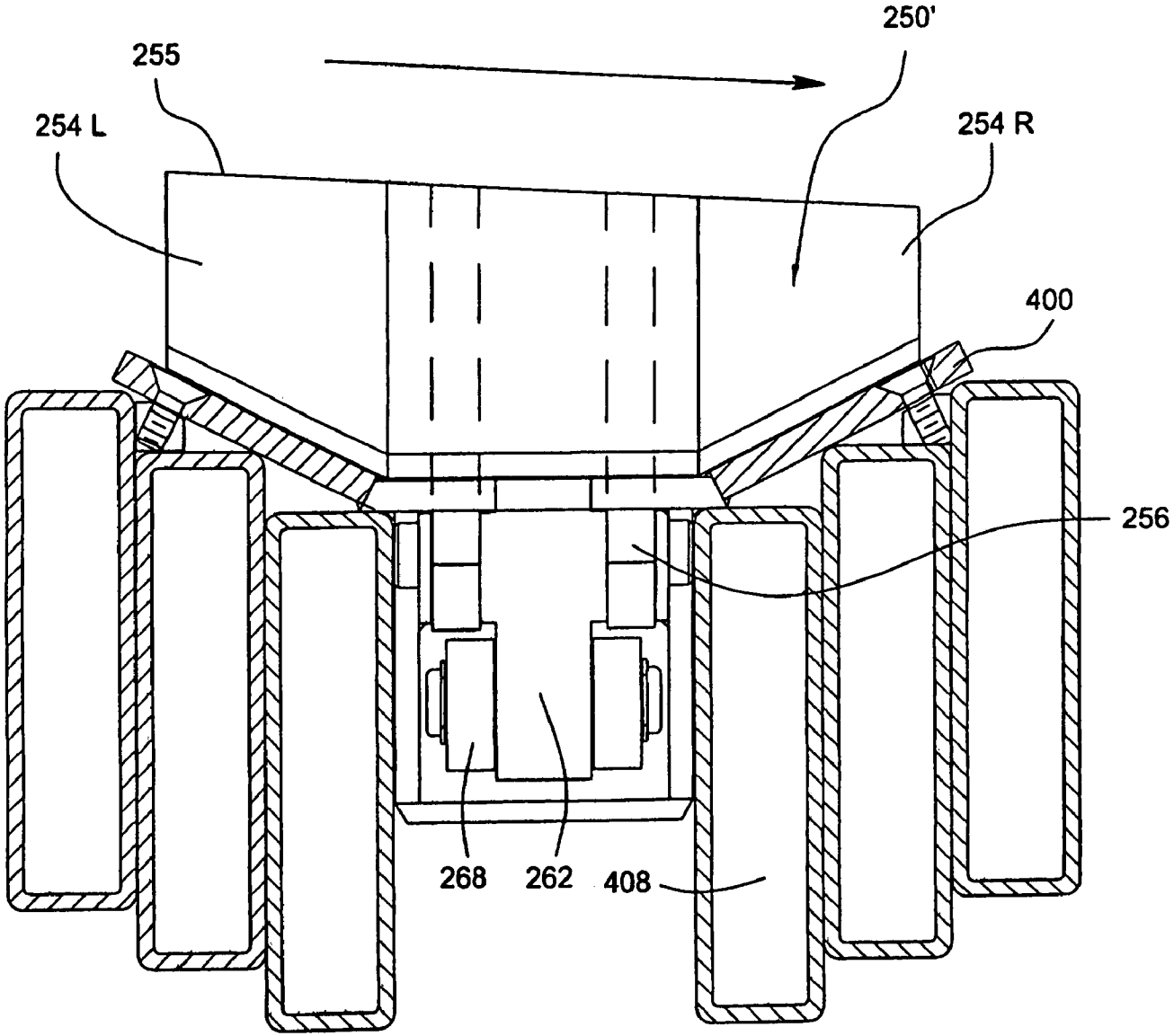
FIG. 12C provides another cross-sectional view of the trough of FIG. 11, allowing a fuller view of a pivoted plate. The view is taken across line 12C-12C of FIG. 11.

FIG. 12B shows the lifting plates 250', 250" of FIG. 11 in a side, cross-sectional view. The view is taken across line 12B-12B of FIG. 11. Each lifting plate 250', 250" is pivotally mounted by a respective pivot point 256. The pivot point 256 may be at one end of the plate (250' or 250") as shown in FIG. 12B, or may be centrally located under the central portion 252. A hydraulic cylinder 262 pivots the lifting plates 250', 250" between their retracted and extended positions. The cylinders 262 are fixed at one end 266. At the opposite end, a telescoping section 264 is pinned to a plate arm 268. The plate arm 268 pivots about the plate pivot point 256, thereby pivoting the respective plates 250', 250" themselves. In FIG. 12B, lifting plate 250' is shown in its extended position. It is understood that only one of the two plates 250', 250" would be actuated or extended at any given time.

The wings 254 of the plates 250', 250" have angled edges. When the plates 250', 250" are rotated, an upper edge 255 of the plates 250', 250" rises above the upper edges of the trough 400. FIG. 12C provides a cross-sectional view of the trough 400, allowing a fuller view of a pivoted plate 250'. The view is taken across line 12C-12C of FIG. 11. It can be seen that the upper edge 255 is inclined toward one side of the trough 400. This causes the cradled pipe (not shown in FIG. 12C) to roll to the right. In FIG. 12C, the leading edge 255 is higher on the left wing portion 254L than on the right wing portion 254R.

As noted, two pairs of lifting plates are preferably employed. The leading edge of one pair will cause the pipe to roll to the left, while the leading edge of the other pair will cause the pipe to roll to the right. In this way, pipe 50 may be ejected to either side of the trestle 200. Furthermore by operating both right and left lifting plates 250", 250", a pipe 50 can be rolled across the trough 400 from one, pipe rack to another.

It is preferred that the pipe pick-up and laydown machine 100 be completely hydraulically controlled. Those of ordinary skill in the art will appreciate that the presence of electrical components near a working drilling rig creates a risk of fire and explosions. Therefore, a purely hydraulic system is demonstrated herein.

In the hydraulically operated system 700, a large reservoir of oil is needed. Further, a set of pilot lines and a set of fluid lines directed to the various hydraulically actuated cylinders are required. In addition, a pump, such as a diesel-powered, pressure compensated, piston pump, is required. The pump provides pressure to feed oil into the various fluid lines and cylinders. Finally, valves are employed to direct fluid through the appropriate lines. These components of a standard hydraulic control system are not shown.

Separate circuits are utilized for the various hydraulic operations. These separate circuits are controlled through joysticks provided on an operator's panel 705. Preferably, the panel 705 is placed on the rig floor 12 to be operated by drilling personnel.

Figure 13:
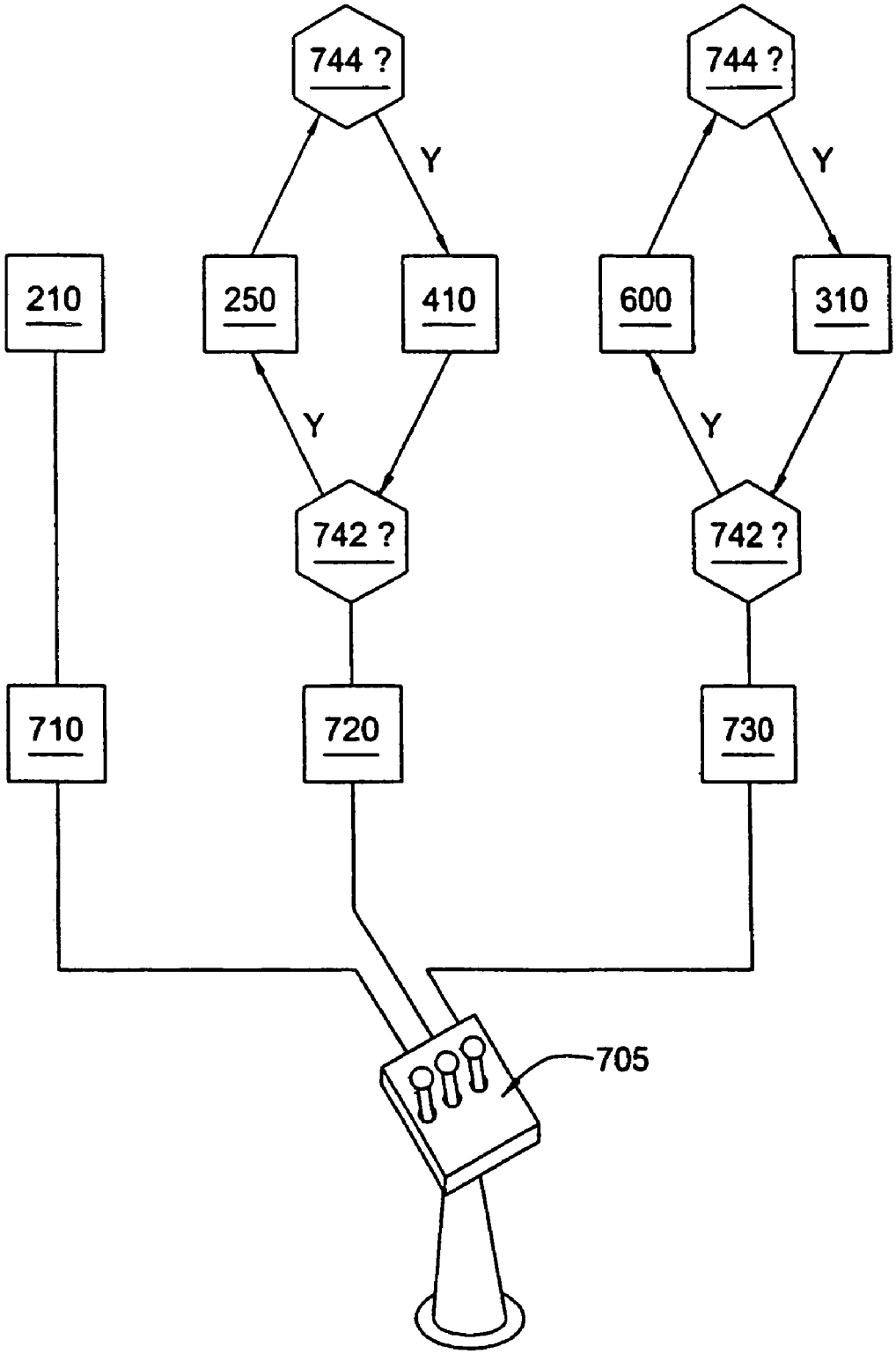

For the present machine 100, a novel hydraulic circuitry 700 is implemented. FIG. 13 provides an exemplary circuit diagram for the hydraulic system 700 of the pipe-handling machine 100. The hydraulic system 700 integrates three separate circuits. Those comprise a trestle transport mechanism circuit 710, a trough transport mechanism/pipe transfer circuit 720, and a trough carrier transport mechanism/pipe loading circuit 730. The three circuits are operated through the panel 705.

It can be seen that a first dedicated circuit 710 is provided for the trestle transport mechanism 210. This is a reference to the hydraulic cylinder 512 employed to lift the carriage 550. The carriage 550, in turn, lifts the forward end 202 of the trestle 200.

A second circuit 720 is provided for two alternative functions. The functions are the trough transport mechanism 410 and the pipe transfer mechanism 250. The trough transport mechanism 410 is a reference to the mechanism 410 used to manipulate the trough 400. In the arrangement shown in FIG. 5C, this comprises cylinder 412C and telescoping section 414C. The pipe transfer mechanism 250 is a reference to the plates 250', 250" employed to eject a pipe 50 from the trough 400, and associated hydraulic hardware, e.g., cylinders 262 and telescoping sections 264.

It should be appreciated that an operator would not employ the pipe transfer cylinders 262 while the trough 400 is being raised or extended. At the same time, the operator would not want to extend the trough 400 while pipe 50 is being ejected by the pipe transfer system 250 on the ground. Therefore, a lockout feature is designed into the hydraulic circuitry 700.

To ensure that one of the mechanisms 410, 250 is locked out while the other is engaged, mechanical positioning valves 742, 744 are provided along the ramp 500 proximate to the top 502 and bottom 504 ends, respectively. When the trestle 200 is on the catwalk 190, a lower position valve (shown schematically at 742 in FIG. 13) directs the flow of hydraulic power to the pipe transfer system 250. When the trestle 200 is raised off the catwalk 190 and reaches the end of its travel at the top of the ramp 500, it activates an upper position valve (shown schematically at 744 in FIG. 13). The upper valve directs the flow of hydraulic power in the second circuit to the trough transport mechanism 410. Thus, a safety feature is built into the hydraulic circuitry 700.

A similar safety arrangement is provided with a third circuit 730. In this respect, a third circuit 730 is provided that also serves two functions. The third circuit 730 alternatively provides hydraulic power to the trough frame carrier transport mechanism 310 and to the pipe loading apparatus 600. The trough frame carrier transport mechanism 310 is a reference to the trough carrier transport mechanism 310 used to manipulate the trough carrier 300. This includes, in the arrangement shown in FIG. 5C, the cylinder 312C the brace 314C, and other features described above. The pipe loading apparatus 600 is a reference to the loading arms 630 and the lifting arms 620, which work together to load pipe 50' from the pipe racks into the trough 400.

It should be appreciated that an operator would not employ the cylinders 312 for the trough carrier transport mechanism while pipe 50 is being loaded into the trough 400 at the catwalk 190. Reciprocally, the operator would not want to operate the lifting arms 620 while the trestle 200 and nested trough carrier 300 and trough 400 are raised. Therefore, these two circuits are also mutually exclusive. To ensure this, the mechanical positioning valves 742, 744 also operate to direct the flow of hydraulic fluid to the proper systems 310 or 600. When the trestle 200 is on the catwalk 190, the lower position valve directs the flow of hydraulic power in the third circuit 730 to the pipe loading system 600. When the trestle 200 is raised off of the catwalk 190 and reaches the rig floor 12, the upper position valve 744 directs the flow of hydraulic power in the third circuit 730 to the trough frame transport mechanism 310. Thus, a safety feature is again built into the hydraulic circuitry 700.

The only time during normal operations (i.e. not test or emergency) when the carrier 300 and trough 400 may be extended and retracted is when the upper position valve 744 is reached. At all other times, their movement is prevented by hydraulic interlocks. While the trestle 200 is in the raised condition, the lifting arms 620 and the cylinders 262 for rotating the ejection plates 250', 250" remain hydraulically disabled in the up position.

The three circuits 710, 720, 730 described above are controlled through joysticks or other levers on the panel 705. Separate joysticks are provided for the three circuits 710, 720, 730. Pilot lines connect the panel to fluid exchange valves. This means that a fluid exchange valve is provided for each of the three circuits 710, 720, 730, and is powered by the pilot lines. The fluid exchange valves selectively direct oil from a high pressure oil supply. In a first position, oil is sent through a fluid line to actuate the corresponding telescoping sections outward. In a second position, the fluid exchange valves are neutral such that no fluid flows through the fluid lines for the respective system. And in the third position, the fluid exchange valves direct fluid to retract the various telescoping sections of the respective cylinders.

In the preferred arrangement, a separate, manually powered system is used to control other cylinders in the machine 100. For example, the stabilizer arms 610 are controlled directly at the pipe racks. Likewise, cylinder 528 is controlled directly for folding the ramp 500 over the trestle 200. Hydraulic circuitry for these systems is not shown. However, based upon the present disclosure, implementation of these systems could be accomplished by one of skill in the art.

To raise a pipe joint within the trough 400 to the rig floor 12, the operator moves the control valve joystick for the trestle transport mechanism circuit 710. Once the trestle 200 clears the upper diverter valve 744 at the top of the ramp 500, the operator may then operate the trough carrier transport mechanism 310 and trough transport mechanism 410, as needed, utilizing the joysticks for the second 720 and third 730 circuits, respectively. After the elevator and pipe are clear above the rig floor 12, the pick-up and laydown machine 100 operator retracts both the carrier 300 and trough 400 within the trestle 200. The trestle 200 is then lowered along the ramp 500 operating the trestle transport mechanism circuit 710. As the trestle 200 lowers to the catwalk 190, the lower fluid diverter valve 742 is released, hydraulically locking the carrier 300 and trough 400 from any further motion until the trestle 200 is again raised up to the rig floor 12.

Figure 14:
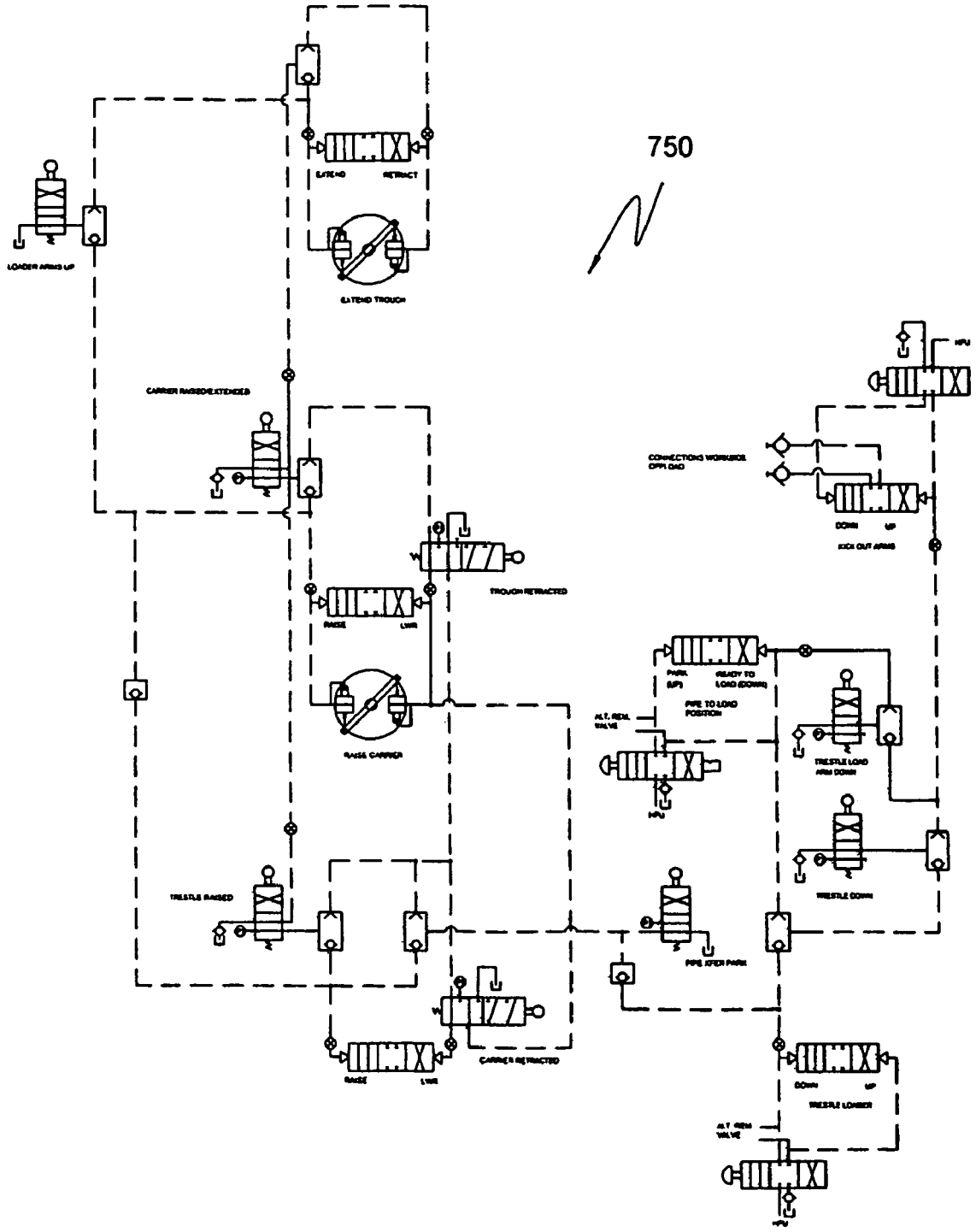

As noted, removal of pipe 50 from the trough 400 is accomplished by actuating the cylinders 262 that cause the lifting plates 250' or 250" to pivot. In one arrangement, enablement is provided not only by the lower position valve 742 actuated by placing the trestle 200 in its lower position, but also by requiring that the stabilizing arm 610 be in its down position. Both conditions may be required. FIG. 14 shows a more detailed view of a hydraulic circuit as might be employed in the pipe-handling machine 100 of the present invention. Under this circuit, the pick-up and laydown machine 100 operator lowers the stabilizer arms 210 using his joystick control. He then operates the ejection cylinders 262 to eject the pipe 50 from the trough 400 to the lifting hands 626 in the ready to load position. From there the pipe 50 may be removed.

A novel method for delivering and for removing a portable pick-up and laydown machine 100 is also provided herein. The present machine 100 is highly portable, being capable of being transported on a flat-bed trailer. To perform the delivery and removal operations, the flat-bed trailer is outfitted with a "fifth wheel." A fifth wheel 180 comprises a shaft extending vertically above the bed of the trailer, and a nut or other fastening device which is received onto the shaft. The fastening device is a large, radial body having a cutout around an approximate 20 degree arc, thereby leaving an opening for receiving the shaft.

A winch 175 is further employed for rotating and moving the machine 100 to and from the catwalk 190. The winch 175 may be an 8,000 pound rated winch capable of being moved to different locations around the trailer 185. It is understood that trailers typically have slots disposed at two-foot intervals around the perimeter of the bed for receiving fasteners and tools, such as a portable winch.

FIG. 15A is a top, schematic view of a machine 100 of the present invention, resting on a flatbed trailer 185 as might be pulled by a truck 182. The trailer 185 is positioned adjacent the catwalk 190 of a drilling rig 10. The trailer 185 with the machine 100 transported thereon is positioned essentially normal to the catwalk 190.

FIG. 15B is a top, schematic view of the machine 100 of FIG. 15A. In this view, the machine 100 has been rotated to a position essentially parallel to the catwalk 190. To accomplish this, the fastening member (not shown) is loosened from the shaft 180 of a fifth-wheel arrangement. This releases the machine 100 from the fifth-wheel connection, while still allowing the machine 100 to pivot about the shaft 180. A wireline 195 (or other winch line) is extended from the forward end of the machine 100, and wrapped around a fixed portion 192 of the V-Door ramp 194. The wireline 195 is then pulled by the winch 175 so as to rotate the machine 100. Arrow 197 demonstrates the direction of rotation of the machine 100.

FIG. 15C demonstrates the machine 100 having been moved into set-up position. In this respect, the machine 100 has been released completely from the fifth wheel connection. The wireline 195 has then been pulled further by the winch 175 so as to draw the machine 100 completely onto the catwalk 190. Arrow 107' demonstrates linear movement of the machine 100 onto the catwalk 190.

FIG. 16A is a top, schematic view of the machine 100 of FIG. 15A. The machine 100 has completed the pipe pick-up and laydown operations, and is now ready to be taken from the drilling site. This means that all components of the machine 100, such as the ramp 500, are nested within or upon the trestle 200. To remove the machine 100 from the catwalk 190, the winch 175 is moved to a side position on the trailer 185 in the longitudinal plane of the machine 100. The wireline 195 is wound from the winch 175 and around a center point of the machine 100. The wireline 195 is then taken up by the winch 175 so as to draw the machine 100 onto the trailer 185.

FIG. 16B presents the machine 100 of FIG. 16A having been pulled onto the trailer 185. The machine 100 is perpendicular to the trailer 185 and must be rotated before it can be transported. Arrow 107' again indicates the linear movement of the machine 100.

FIG. 16C is a top, schematic view of the machine 100 of FIG. 16B, with the winchline 195 having been reconfigured. In this respect, the winchline 195 is now tied to the forward end of the machine 100. The machine 100 is engaged with the shaft 180 of the fifth wheel so as to form a pivot point on the trailer bed 185. The machine 100 can now be rotated into proper orientation for transport on the flatbed trailer 185.

In FIG. 16D, the machine 100 has been rotated by the winchline 195 so as to be property positioned on the trailer 185 for transport. Arrow 107 indicates rotational movement of the machine 100.

While the foregoing is directed to some embodiments of the present invention, other and further embodiments of the invention may be devised without departing from the basic scope thereof, and the scope thereof is determined by the claims that follow.

The invention claimed is:

1. A pipe-handling machine for manipulating joints of pipe at a rig site, pipe-handling machine comprising:

an elongated trough having a first end, a second end, and an upper receiving surface, the upper surface being configured to receive a joint of pipe, and wherein the elongated trough is configured to support a majority of the joint of pipe along the pipes longitudinal axis;

an elongated trough carrier, the elongated trough carrier having a first end, a second end, and an upper receiving surface, the upper surface of the elongated trough carrier being configured to receive the elongated trough and allow the elongated trough to move longitudinally relative to the elongated trough carrier;

an elongated trestle having a first end, a second end, and an upper receiving surface, the upper surface of the elongated trestle being configured to receive the elongated trough carrier and allow the elongated trough carrier to move relative to the elongated trestle;

a carriage connectible to the first end of the elongated trestle;

an inclined ramp having a first end, a second end, and a guide system therebetween, the guide system slidably receiving the carriage; and a trestle transport mechanism for transporting the first end of the elongated trestle from the first end of the inclined ramp to the second end of the inclined ramp.

2. The pipe-handling machine of claim 1:

wherein the pipe-handling machine further comprises a base having a first end, a second end, and a second guide system therebetween, the second guide system slidably receiving the elongated trestle at the second end of the elongated trestle;

and wherein the first end of the inclined ramp is pivotally connected to the base proximate the first end of the base.

3. The pipe-handling machine of claim 2, wherein the trestle transport mechanism is hydraulically actuated.

4. The pipe-handling machine of claim 3, further comprising a trough transport mechanism for slidably moving the elongated trough axially along the upper surface of the elongated trough carrier.

5. The pipe-handling machine of claim 4, wherein the trough transport mechanism is hydraulically actuated.

6. The pipe-handling machine of claim 5, further comprising a trough carrier transport mechanism for moving the elongated trough carrier relative to the upper surface of the elongated trestle.

7. The pipe-handling machine of claim 6, wherein the trough transport mechanism is hydraulically actuated.

8. The pipe-handling machine of claim 7, wherein the trough carrier transport mechanism moves the elongated trough carrier axially along the upper surface of the elongated trestle.

9. The pipe-handling machine of claim 7, wherein the trough carrier transport mechanism causes the second end of the elongated trough carrier to be lifted upwards above the upper surface of the elongated trestle.

10. The pipe-handling machine of claim 7, wherein the trough carrier transport mechanism both moves the elongated trough carrier axially along the upper surface of the elongated trestle, and causes the second end of the elongated trough carrier to be lifted upwards above the upper surface of the elongated trestle.

11. The pipe-handling machine of claim 2, wherein the elongated trestle further comprises an articulating leg, the articulating leg having a first point pivotally connected to the elongated trestle proximate to the second end of the elongated trestle, and a second point that rides within the guide system of the base;

the guide system of the base further comprises a stop member intermediate the first and second ends of the base;

whereby the second point of the articulating leg contacts the stop member as the first end of the elongated trestle is carried up the inclined ramp, thereby causing the second end of the elongated trestle to be raised upward above the base.

12. The pipe-handling machine of claim 2, wherein the inclined ramp is comprised of at least three modules for increasing the length of the inclined ramp.

13. The pipe-handling machine of claim 12, wherein the trestle transport mechanism comprises:

a hydraulic cylinder disposed along the inclined ramp, the hydraulic cylinder having at least one telescoping section;

a sheave disposed at the end of the at least one telescoping section of the hydraulic cylinder; and a chain connected to the carriage, the chain riding over the sheave as the carriage is moved from a point proximate the first end of the inclined ramp to a point proximate the second end of the inclined ramp.

14. The pipe-handling machine of claim 13, wherein the chain is connected to the carriage by a chain connector, the chain connector comprising:

a bracket having an opening for receiving the chain;

a fastening bolt movably connected to the bracket, the bolt having a first end external to the bracket, and a second end within the opening for selectively engaging and releasing the chain.

15. The pipe-handling machine of claim 2, wherein the elongated trestle further comprises at least two first pipe-carrying arms for receiving a joint of pipe, the first pipe-carrying arms being disposed on a first side of the trestle.

16. The pipe-handling machine of claim 15, wherein each of the pipe-carrying arms further comprises a hand for selectively receiving a joint of pipe, and for releasing the joint of pipe into the upper surface of the trough.

17. The pipe-handling machine of claim 15, wherein the elongated trestle further comprises at least one stabilizing arm on the first side of the trestle.

18. The pipe-handling machine of claim 17, wherein the at least one stabilizing arm further comprises a hand, the hand having a bottom concave surface for engaging a joint of pipe when the first pipe-carrying arms receive a joint of pipe.

19. The pipe-handling machine of claim 15, wherein the elongated trestle further comprises at least Iwo second pipe-carrying arms for receiving a joint of pipe, the second pipe-carrying arms each being disposed on an a second opposite side of the elongated trestle.

20. The pipe-handling machine of claim 11, wherein each of the at least two second pipe-carrying arms further comprises a hydraulically actuated hand for selectively receiving a joint of pipe from the upper surface of the elongated trough, and for releasing the joint of pipe.

21. The pipe-handling machine of claim 1, wherein the elongated trough further comprises at least two lifting plates within the upper concave surface of the elongated trough, the at least two lifting plates being movable from a first retracted position to a second extended position, the lifting plates being configured to receive a joint of pipe when in the retracted position, and to expel a joint of pipe to one side of the pipe-handling machine when in the extended position.

22. The pipe-handling machine of claim 21, wherein the at least two lifting plates are hydraulically actuated.

23. The pipe-handling machine of claim 1, wherein the elongated trough further comprises at least four lifting plates within the upper concave surface of the trough, each of the at least four lifting plates being movable from a first retracted position to a second extended position, each of the at least four lifting plates being configured to receive a joint of pipe when in the retracted position, at least two of the lifting plates being configured to expel a joint of pipe to one side of the pipe-handling machine when in the extended position; and at least two of the lifting plates being configured to expel a joint of pipe to a second opposite side of the pipe-handling machine when in the extended position.

24. The pipe-handling machine of claim 23, wherein the at least four lifting plates are hydraulically actuated.

25. The pipe-handling machine of claim 2, wherein the pivoting connection between the inclined ramp and the base is configured to permit the inclined ramp to be folded over the elongated trough.

26. The pipe-handling machine of claim 1, wherein the pipe-handling machine is dimensioned to be received upon and transported by a flat-bed trailer without necessity of a DOT permit.

27. A pipe-handling machine for manipulating joints of pipe at a rig site, the pipe-handling machine comprising:

a trough for receiving and supporting a joint of pipe along a longitudinal axis of the joint of pipe and configured to move with the joint of pipe toward a center of a rig floor;

a trough carrier for receiving the trough and along a longitudinal axis of the trough and configured to support a majority of the trough, wherein the trough carrier is configured to move to a unloading position wherein a portion of the trough carrier is above the rig floor;

a trestle for receiving the trough carrier, the trestle having a first end and a second end;

a ramp having a lower end and an upper end, the ramp pivotally connected to the first end of the trestle;

a hydraulically operated trestle transport mechanism for transporting the first end of the trestle between the upper and lower ends of the ramp;

a hydraulically operated trough transport mechanism for slidably moving the trough axially along the trough carrier and configured to extend the trough beyond the end of the trough carrier when the trough carrier is in the unloading position; and a hydraulic control system.

28. The pipe-handling machine of claim 27, wherein:

the trestle further comprises at least two pipe-carrying arms for receiving a joint of pipe, the pipe-carrying arms being disposed on an a side of the trestle; and the pipe-carrying arms are actuated by the hydraulic system.

29. The pipe-handling machine of claim 27, wherein: the trough further comprises at least two lifting plates, the at least two lifting plates being movable from a first retracted position to a second extended position, the lifting plates being configured to receive a joint of pipe when in the retracted position, and to expel a joint of pipe to one side of the pipe-handling machine when in the extended position; and the at least two lifting plates are actuated by the hydraulic system.

30. The pipe-handling machine of claim 27, wherein:

the trough further comprises at least four lifting plates within the upper concave surface of the trough, each of the at least four lifting plates being movable from a first retracted position to a second extended position, each of the at least four lifting plates being configured to receive a joint of pipe when in the retracted position, at least two of the lifting plates are configured to expel a joint of pipe to one side of the pipe-handling machine when in the extended position;

least two of the lifting plates are configured to expel a joint of pipe to a second opposite side of the pipe-handling machine when in the extended position; and each of the at least four lifting plates is actuated by the hydraulic system.

31. The pipe-handling machine of claim 29, further comprising a trough carrier transport mechanism for moving the trough carrier relative to the trestle.

32. The pipe-handling machine of claim 31, wherein the hydraulic control system is configured such that:

actuation of the trough transport mechanism and the trough carrier transport mechanism is locked out when the first end of the trestle transport mechanism reaches a point along the ramp proximate to the lower end of the ramp; and actuation of the at least two lifting plates is locked out when the first end of the trestle transport mechanism reaches a point along the ramp proximate to the upper end of the ramp.

33. The pipe-handling machine of claim 1, wherein the second end of the elongated trough carrier is capable of being lifted above the upper surface of the elongated trestle.

34. The pipe-handling machine of claim 28, wherein the trough is configured to be movable relative to the trough carrier.

35. The pipe-handling machine of claim 34, wherein the trough carrier is configured to be axially movable relative to the trestle.

36. The pipe-handling machine of claim 35, wherein the trough carrier is configured to be rotationally movable relative to the trestle.

37. A pipe-handling machine for manipulating joints of pipe at a rig site, the pipe-handling machine comprising:

a pipe tray configured to support the majority of a joint of pipe along a longitudinal axis of the pipe;

a first elongated frame configured to support a majority of the pipe tray as the pipe tray travels longitudinally along a longitudinal axis of the first elongated frame;

a second elongated frame configured to receive the first elongated frame, the second elongated frame having a first end and a second end;

a ramp along which the second elongated frame rides, the ramp being inclined in the direction of a wellbore operation platform;

a first actuator for extending the second elongated frame to a location proximate the wellbore operation platform when the first end of the second elongated frame is delivered along the ramp to a position above an elevation of the wellbore operation platform;

a second actuator configured to lift the second end of the first elongated frame relative to the second end of the second elongated frame thereby reducing the angle of approach of the first elongated frame to the wellbore operation platform when the first end of the second elongated frame is delivered along the ramp to the position above an elevation of the wellbore operation platform, wherein the first elongated frame in configured to be above the wellbore operation platform; and a third actuator configured to move the pipe tray along a longitudinal axis of the first elongated frame thereby delivering the pipe tray and the joint of pipe of a position above a wellbore.

38. The pipe handling machine of claim 37, wherein the second actuator pivots the first elongated frame relative to the ramp.

39. The pipe-handling machine of claim 1, further comprising a ramp actuator configured to pivot the inclined ramp to a position over the elongated trestle.

40. The pipe-handling machine of claim 4, wherein the first end of the elongated trough carrier is configured to move to a position above a rig floor when the trough carrier is in an unloading position for unloading the joint of pipe to the rig site.

41. The pipe-handling machine of claim 40, wherein the trough transport mechanism is configured to move the first end of the elongated trough toward a center of the rig floor beyond the first end of the elongated trough carrier when the trough carrier is in the unloading position, thereby moving the joint of pipe near the center of the rig floor.

42. The pipe-handling machine of claim 27, further comprising a ramp actuator configured to pivot the ramp between a retracted position and an extended position relative to the trestle, wherein in the retracted position the ramp is located above the trestle for shipment of the pipe-handling machine.

43. The pipe-handling machine of claim 37, further comprising a ramp actuator configured to move the ramp between a retracted position and an extended position relative to the second elongated frame, wherein in the retracted position the ramp is located above the second elongated frame for shipment of the pipe-handling machine.

44. The pipe-handling machine of claim 43, further comprising a modular ramp sections configured to extend and retract the length of the ramp in order to adapt to the height of the wellbore operation platform.

* * * * *

UNITED STATES PATENT AND TRADEMARK OFFICE

CERTIFICATE OF CORRECTION

PATENT NO. : 7,404,697 B2
APPLICATION NO. : 10/513543
DATED : July 29, 2008
INVENTOR(S) : Thompson It is certified that error appears in the above-identified patent and that said Letters Patent is hereby corrected as shown below:

Column 22, Claim 19, Line 59, please delete “Iwo” and insert --two-- therefor;

Column 24, Claim 30, Line 15, please insert --at-- before “least”.

Signed and Sealed this

Tenth Day of February, 2009

John Doll

JOHN DOLL
*Acting Director of the United States Patent and Trademark Office*